US005389960A

United States Patent [19]

Onishi

[11] Patent Number: 5,389,960

[45] Date of Patent: Feb. 14, 1995

[54] DYE RECORDING METHOD AND DYE RECORDING APPARATUS THEREFOR DYE RECORDING APPARATUS THEREFOR, THERMAL HEAD THEREFOR AND RECORDING INK FOR DYE RECORDING

[75] Inventor: Hiroshi Onishi, Osaka, Japan

[73] Assignee: Matsushita Electric Industrial Co., Ltd., Kadoma, Japan

[21] Appl. No.: 772,531

[22] Filed: Oct. 7, 1991

[30] Foreign Application Priority Data

| | | | |
|---|---|---|---|
| Oct. 9, 1990 | [JP] | Japan | 2-271118 |
| Jan. 28, 1991 | [JP] | Japan | 3-008325 |
| Mar. 8, 1991 | [JP] | Japan | 3-043363 |
| Apr. 26, 1991 | [JP] | Japan | 3-097512 |

[51] Int. Cl.[6] ..... B41J 2/32

[52] U.S. Cl. ..... 346/224; 346/203

[58] Field of Search ..... 346/1.1, 76 PH, 762, 346/108, 76 R

[56] References Cited

FOREIGN PATENT DOCUMENTS

| | | |
|---|---|---|
| 50-9631 | 1/1975 | Japan . |
| 51-124119 | 10/1976 | Japan . |
| 52-47824 | 4/1977 | Japan . |

OTHER PUBLICATIONS

*IEEE Transaction on Consumer Electronics*, vol. CD-28, No. 3, pp. 226-231 (Aug. 1982).

*Primary Examiner*—Benjamin R. Fuller
*Assistant Examiner*—Huan Tran
*Attorney, Agent, or Firm*—Willian Brinks Hofer Gilson & Lione

[57] ABSTRACT

A fluid ink including dye is supplied to the surface of a recording medium having a dyed layer which can be dyed with a dye, and the ink around the dyed layer is heated selectively according to image signal, and the dye diffuses into the dyed layer. Then, the ink is removed from the surface to get a dyed recorded image. Recording sensitivity is high, and a gradation recording image can be obtained. The running cost of this dye recording is low by collecting the removed ink.

48 Claims, 20 Drawing Sheets

Fig. 17
Fig. 17(A)
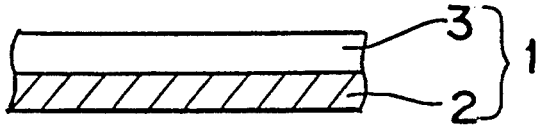
Fig. 17(B)
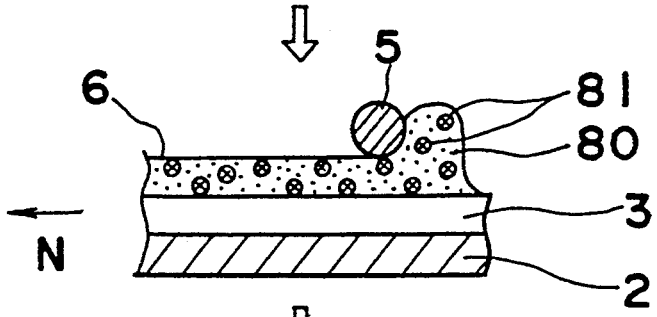
Fig. 17(C)
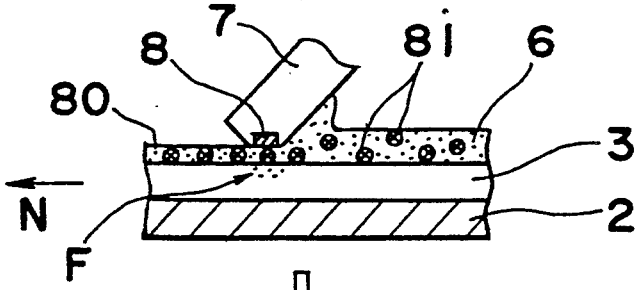
Fig. 17(D)
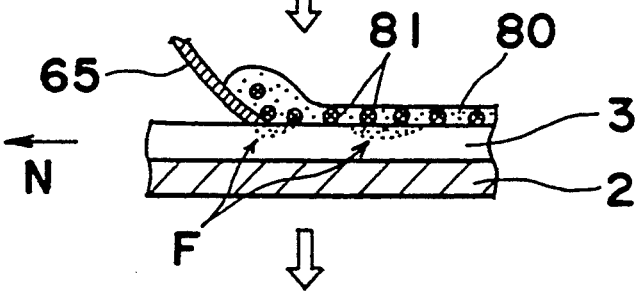
Fig. 17(E)
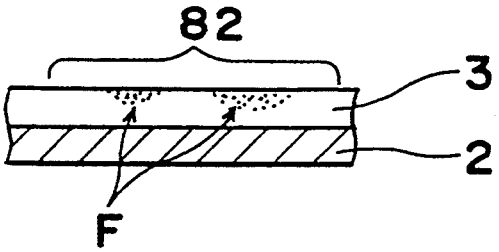

DYE RECORDING METHOD AND DYE RECORDING APPARATUS THEREFOR DYE RECORDING APPARATUS THEREFOR, THERMAL HEAD THEREFOR AND RECORDING INK FOR DYE RECORDING

BACKGROUND OF THE INVENTION

1. Field of the Invention

The present invention relates to a dye recording method for recording a half-tone image with dyeing by heating selectively the ink supplied to the surface of a recording medium, a dye recording apparatus therefor, a recording ink for the dye recording method and a thermal head used for the dye recording apparatus.

2. Prior Art

Recently, thermal transfer recording of the sublimation type has attracted attention because excellent gradation recording can be realized and a full-color image can be recorded. In the method, an ink sheet having an ink layer including a sublimation dye is provided, and the dye is transferred by thermal printing from the rear side of the ink sheet to a recording medium having a dyed layer which can receive the sublimed dye.

In a thermal transfer recording apparatus for performing the thermal transfer recording (refer for example IEEE Transaction on Consumer Electronics, Vol. CE-28, No. 3, pp. 226–231, August 1982), a recording medium having the dyed layer is supported on a platen, while an ink sheet having the ink layer supported on a sheet-like substrate is supplied between a platen and a thermal head and the ink layer is pressed to the dyed layer. The dyed layer includes a dye which can sublime. Then, heating elements in the thermal head are heated selectively according to image signal and the dye included in the ink layer is transferred to the dyed layer. The transferred dye forms a transferred ink image.

However, in such dye recording, when the dye is transferred thermally, the air included between the ink sheet and the head, the sheet-like substrate and the ink layer must also be heated. Especially, the sheet-like substrate has to be heated at a temperature above that of the dye in order to heat from the rear side of the ink sheet. Therefore, a large amount of power is needed for dye recording.

Further, because the ink extracted from an ink sheet by heating is hard to be supplemented, the ink sheet is discarded. Therefore, the running cost is high and the resources cannot be used effectively.

SUMMARY OF THE INVENTION

An object of the present invention is to provide a dye recording method wherein dye recording of high sensitivity can be performed.

Another object of the present invention is to provide a dye recording method wherein dye recording can be performed at a low running cost with resources used effectively.

A still another object of the present invention is to provide a dye recording apparatus wherein dye recording can be performed at a low running cost with resources used effectively.

A further object of the present invention is to provide a thermal head wherein dye recording of high sensitivity can be performed at a low running cost with resources used effectively.

A still further object of the present invention is to provide an ink for dye recording wherein dye recording of high sensitivity can be performed at a low running cost with resources used effectively.

In a dye recording method according to the present invention, a printing medium having a dyed layer which can be dyed with a dye is provided, and a fluid ink including the dye is supplied on a surface of the dyed layer. Then, the fluid ink supplied to the dyed layer is heated, and the fluid ink is removed from the surface of said printing medium after the heating. Thus, a half-tone image can be recorded by controlling the heat amount according to image signals.

A dye recording apparatus according to the present invention comprises a printing medium having a dyed layer which can be dyed with a dye, a fluid ink including the dye; an ink supplier for supplying the fluid ink on a surface of the dyed layer of the printing medium, a heater for heating the fluid ink selectively, and a removing device for removing the fluid ink from the surface of the recording medium. The ink supplied by the ink supplier is heated with the heater and the ink is removed after heating from the dyed layer with the removing device to get a dye printing image on the printing medium.

A fluid ink for dye recording according to the present invention comprises a solvent having low solubility into the dyed layer of a recording medium and dye which can diffuse to the dyed layer under heating.

A thermal head for dye recording according to the present invention comprises a plurality of heating elements formed on a surface, and a protection layer formed on the heating elements, which layer being uneven in a direction crossing the plurality of heating elements so as to form passages for fluid ink.

It is an advantage of the present invention that the recording sensitivity is improved and that a half-tone image can be recorded.

It is another advantage of the present invention that the resources can be used effectively.

BRIEF DESCRIPTION OF THE DRAWINGS

These and other objects and features of the present invention will become clear from the following description taken in conjunction with the preferred embodiments thereof with reference to the accompanying drawings, and in which:

FIGS. 17(A)-(E) are diagrams showing the dye recording procedure adopted for the dye recording apparatus of the sixth embodiment;

DETAILED DESCRIPTION OF THE PREFERRED EMBODIMENTS

Figure 1A:
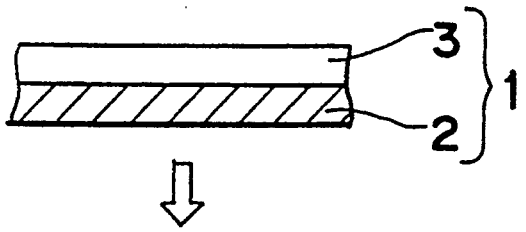
FIGS. 1(A)–(D) are diagrams showing the dye recording method of an embodiment of the invention.
Figure 1B:
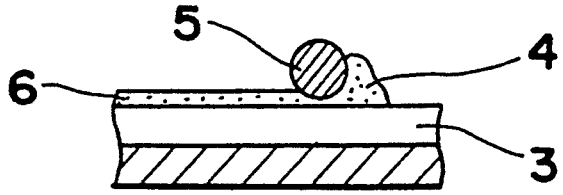
Figure 1C:
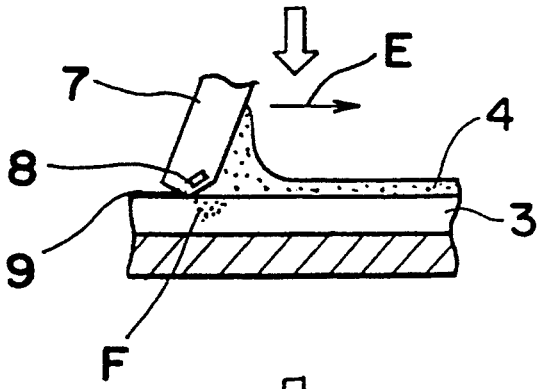
Figure 1D:
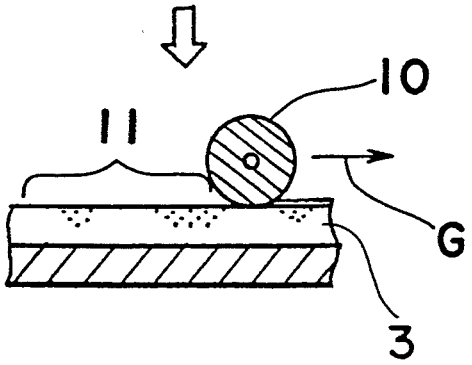

Embodiments of the present invention will be described below with reference to the appended drawings throughout which like parts are designated by like reference numerals.

FIGS. 1(A)-(D) show the dyeing procedure of an embodiment of dye recording method according to the present invention, wherein numeral 1 designates a recording medium, numeral 2 designates a sheet-like substrate of the recording medium 1, numeral 3 designates a dyed layer having a dyeing property so that the layer can be dyed with a dye, numeral 4 designates a fluid ink including the dye, numeral 5 designates a wire bar for supplying the ink 4 to the surface of the dyed layer 3 of the recording medium 1, numeral 6 designates an ink layer formed on the surface of the dyed layer 3 with use of the wire bar 5, numeral 7 designates a thermal head for heating the ink around the dyed layer 3, numeral 8 designates a heating element arranged at the top of the thermal head 7 which can be heated by electric power, numeral 9 designates residual ink remaining on the surface of the dyed layer 3 after the heating, and numeral 10 designates a felt roller for removing the residual ink 9.

A recording medium 1 has a dyed layer 3 applied to the surface of a substrate 2, as shown in FIG. 1(A).

Next, the procedure of the dye recording method is explained with reference to FIG. 1. First, an ink fluid layer 6 is formed on the surface of the dyed layer 3 of the recording medium 1 with use of a wire bar 5 (refer FIG. 1(B)). Next, a thermal head 7 presses the dyed layer 3 via the ink layer 6, and moves in the direction E removing almost all ink 4 from the surface of the dyed layer 3. At the same time, heating elements 8 provided at the top of the thermal head 7 are heated according to image signals to cause the diffusion F of the dye around the contact area into the dyed layer. Electric power supplied to a heating element 8 is controlled to give a gradation image. Because the thermal head 7 is pressed to the dyed layer 3, almost all ink 4 is removed from the dyed layer 3 according to the movement of the recording medium 1 in the direction F, while a small amount of the ink 9 remains on the surface as residual ink 9 (refer FIG. 1(C)) in order to reduce the collection of ink before the thermal head 7. Finally, the residual ink 9 is wiped by moving a felt roller 10 made of felt in the direction G, and a recording image 11 dyed by the diffusion F into the dyed layer 3 (shown as dots in the dyed layer 3) is obtained (refer FIG. 1(D)) which reflects the amount of heat applied. The amount of dye carried into the dyed layer 3 due to the diffusion F varies with the image signal, and a half-tone image can be recorded.

As explained above, in a dye recording method of this embodiment, a fluid ink 4 including dye is first supplied to the dyed layer 3. Because the ink 4 is fluid, the ink 4 can be supplied to the surface of the dyed layer 3 easily with use of a prior art coating technique. The dye is dispersed or dissolved in the ink 4, and the dye combined with the solvent included in the ink 4 makes contact with the surface of the dyed layer 3. If heating is performed in this state, the thermal diffusion F of the dye into the dyed layer 3 increases with increase in the temperatures of the dye and the layer. In this way, the dye migrates to the dyed layer 3 and the dyeing with the dye is performed. Because the amount of dyeing is proportional to the amount of heat applied, gradation recording can be realized by controlling the heat amount according to image signal. On the other hand, when the heating is not performed, the thermal diffusion of the dye is small, and dyeing does not accompany a fog in the recording image 11.

Further, only the ink around the dyed layer 3 is heated directly as explained above, so that excessive heating is not necessary as in a prior art sheet-like substrate and recording sensitivity can be improved. Still further, the energy efficiency of the diffusion of dye due to heating is better because the ink is fluid, compared with a prior art solid ink layer. Only the diffused dye is exhausted in the ink 4, and the ink 4 can be used again easily by resupplying dye to the ink 4. Thus, the running cost becomes low and the resources can be used effectively.

The substrate 2 of the recording medium 1 is preferably a synthetic paper, an art paper, a coat paper, a wood-free paper, a baryta paper, a cellulose fiber paper or a plastic film or a composite of layers thereof.

The dyed layer 3 of the recording medium 1 includes a resin having a better dyeing property against the dye included in the ink 4 with increasing temperature. The resin not limited to a specific material. For example, the dyed layer 3 is made form a polyester resin, polyvinyl chloride resin, a copolymerization resin of vinyl chloride/vinyl acetate, an acrylic resin, a nylon resin, a silicone resin or butyral resin or a mixture thereof. The dyed layer 3 can be obtained, for example, by coating and drying with a solution, in which is dissolved such a resin with a solvent coating technique.

The ink 4 includes a dye which diffuses into the dyed layer 3 better with increasing temperature, and it is not limited to a specific ink. However, if a fluid is included in a composition of the ink 4, a solvent having a low solubility of the constituent materials of the dyed layer 3 is selected. If the solvent has a high solubility of the dyed layer 3, the solvent will penetrate the dyed layer when the ink 4 contacts the dyed layer 3. Therefore, even if the thermal diffusion of dye is small at room temperature, the dye penetrates in the dyed layer 3 to be dyed. That is, the dyed layer has a color only if it contacts the ink 4. Thus, the solvent included in the ink 4 is required to have a low solubility in the dyed layer 3, as mentioned above.

The solvent may be water, an organic solvent such as an alcohol, a hydrocarbon or a silicone oil, a liquid polymer such as polybutene, polybutadiene or polyisobutylene, a liquid wax such as fluid paraffin, or a mixture thereof. Further, though the solvent included in the ink 4 is required to have a low solubility in the dyed layer 3 as explained above, a solvent having a good solubility in the dyed layer 3 may also be added in order to improve the dispersion or solubility of the dye. In this case, a mixed solvent including mainly a main solvent having a low solubility is used to control the solubility of the dyed layer 3 to become. The main solvent has the largest weight ratio among the solvents included in the ink 4.

The solvent may have no solubility of dye. In this case, the dye is dispersed in the ink 4.

As mentioned above, the ink 4 for dye recording according to the present invention has a solvent having a low solubility in the dyed layer. Therefore, the penetrating property of the solvent in the dyed layer 3 is low enough to ensure that the dye will not penetrate into the dyed layer 3 upon contact of the dyed layer with the ink, and a good recording image with little fog can be obtained. Further, the ink 4 is fluid due to the solvent, so that the dye can be supplied uniformly to the surface of the dyed layer 3.

The dye may be a dyeing material having a dyeing property such as a water-soluble dye, an oil-soluble dye or a dispersion dye. If a black dye is used, a black and white image can be recorded, while if dyes of cyan, magenta and yellow and further black are used successively, a full-color image can be recorded.

The ink 4 contains between 1 and 80 wt % of dye, preferably between 5 and 60 wt %. If the weight ratio is less than 1 wt %, a sufficient recording density cannot be realized on dyeing, while if the weight ratio is more than 80 wt %, the ink is not fluid even if a solvent of low viscosity is added. The ink 4 may include further a suitable amount of a surface active agent, fine particles for controlling fluidity and dispersing property such as inorganic particles of $SiO_2$, $TiO_2$, $CaCO_3$ or the like or organic particles of fluorine resin or the like, an ultraviolet absorption absorbent or an oxidation inhibitor.

Preferably, the boiling point of the solvent included in the ink 4 is set above the melting point, the boiling point or the sublimation point of the dye because the diffusion of the dye into the dyed layer during heating becomes greater according to phase change, e.g., upon crossing the melting point, the boiling point or the sublimation point, and this makes it possible to record at a high density. On the contrary, if the solvent boils on heating, bubbles arise in the surface of the dyed layer 3. Thus, the contact of the ink 4 with the dyed layer 3 becomes inhomogeneous to lower the image quality. Therefore, the boiling point of the solvent is set above the melting point, the boiling point or the sublimation point of the dye, so that the solvent does not boil on heating the ink 4, and a recording image of high density and of good quality can be obtained.

Further, only the dye is consumed when the ink is heated if 4 the boiling point of the solvent is above the melting point, the boiling point or the sublimation point of the dye, and the ink 4 can be recycled easily by adding more dye. Then, the resources can be used effectively, and the running cost can be lowered.

Preferably, the solvent includes water, alcohol or silicone oil. Where the dyed layer 3 is made of a lipophilic material including a resin as mentioned above, it is preferable that the solvent have a low solubility of lipophilic material. The above-mentioned solvents have low toxicity among such solvents and are easily handled.

If the solvent is alcohol, it is preferable to use a polyvalent alcohol having low solubility in the dyed layer as a main solvent because a monovalent alcohol has a higher solubility among alcohols and is more likely to form a fog on the recording medium.

The alcohols suitable for the solvent include an organic compound wherein one or a plurality of hydrogens of a hydrocarbon are substituted by hydroxy groups. Monovalent alcohols include for example ethanol, methanol, isopropyl alcohol, butanol or cyclohexenol, while a multivalent alcohol is for example ethylene glycol, propylene glycol, butylene glycol, trimethylene glycol, glycerin or trimethylol propane.

The above-mentioned silicone oil has a cyclohexane structure as shown below, wherein $R_1$ to $R_8$ designate a methyl group, a phenyl group, a long chain alkyl group, a chlorophenyl group, a trifluoroalkyl group or a hydrogen.

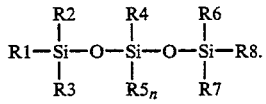

If the solvent of the ink 4 includes silicone oil preferably, the smoothness at the contact between the thermal head 7 and the dyed layer 3 can be improved allowing easier movement of the recording medium 1 against the thermal head.

The solvent preferably has a viscosity at room temperature of 1000 mPa.s or less, otherwise the viscosity of the ink 4 is too high to be supplied homogeneously because of lack of fluidity.

The dye in the ink has preferably median size of 50 μm or less, preferably of 20 μm or less. The median size means a particle size at which the weight of particles attains 50% of the total weight when the weight of particles are added in the order of decreasing particle size. If there are included many particles of median size larger than 50 μm, the heat capacity becomes high and dyeing with low energy becomes difficult, while the resolution of a recording image becomes lower due to the particle size. Further, large particle size can contribute to choking upon supplying the ink 4 and may prevent the formation of a homogeneous ink fluid layer lowering the quality of resultant image. Therefore, it is preferable to limit the maximum particle size to 100 μm or below.

The ink 4 may consist of a fluid dye of liquid or paste. Because such a dye is fluid at room temperature, it is not necessary to add a solvent. Further, even if the dye is consumed, the dye density is kept constant (100%) because the ink consists only of dye. Therefore, the recording characteristic are not affected by the consumption of the dye. Of course, the above-mentioned solvent can be added to the fluid dye.

CI. Solvent Blue 98, CI. Solvent Yellow 107, CI. Solvent Red 164, 165 or the like are known as a liquid dye. They are a viscous liquid at room temperature (for example at 25° C.) and the viscosity decreases with increasing temperature.

Fluid dyes being paste-like at room temperature are disclosed for example in Japanese Patent laid open Publications JP-A 50-9631/1975, 51-124119/1976, 52-47824/1977. For example, a dye is known wherein a dye including metal such as copper phthalocyanine is dissolved in a hydrocarbon solvent.

The ink 4 may include a resin material soluble in the solvent, in addition to a dye and a solvent. If the solvent is water or an alcohol, a water-soluble resin may be included such as polyethylene glycol, polyvinyl alcohol, polyethylene oxide, carboxymethyl cellulose, hydroxymethyl cellulose, polyvinyl pyrolydone, starch, gelatine, locust bean gum, guar gum, or sodium alginate. The boiling point of the solvent increases by adding such a resin material to the ink 4. Therefore, the ink can be heated to a higher temperature while maintaining stable recording characteristic.

The thermal head 7 comprises a substrate, heating elements and electrodes for supplying electric power to the heating element and a protection layer on the surface. For example, the substrate is made of an insulating substrate such as alumina or an enamel, the heating elements are made of an electrically resistant material such as $Ta_2N$, W, Ni—Cr or $SnO_2$, the electrodes are made of an electrically conducting material such as Al, Ag, Cu or Au, and the coating layer is made of an inorganic material such as $SiO_2$, SiC, SiN, MgO or $Al_2O_3$ which does not react with the ink kept in contact on heating. The layering of each of the components is performed with the use of any film-forming technique such as vacuum deposition, electron beam deposition, sputtering, chemical vapor deposition or gas phase growth. It is desirable that these films have heat-resistant properties at 300° C. or above.

A heater provided in the thermal head 7 usually consists of heating elements 8 which can be heated with electric conduction and one or a plurality of protection layers applied to the surfaces of the heating elements 8. The surfaces are designed to make direct contact with the ink 4 or the like.

In this embodiment, the wire bar 5 is used to provide the ink 4 to the surface of the dyed layer 3, and the felt roller 10 is used to remove the ink 4. However, other means can also be used to perform the action.

Further, heat conduction can be improved by dispersing heat-conducting powders in the ink 4. The powders may be made of a metal such as copper, stainless steel or iron, or of an inorganic material such as alumina, graphite or glass.

In order to form the ink fluid layer 6, a general coating means such as a roller or a felt may also be used instead of the felt roller shown in FIG. 1.

In order to remove the ink from the surface of the dyed layer 3, a blade, a rubber roller, air blow, cleansing with an insoluble solvent or the like may also be used instead of the felt roller 10 shown in FIG. 1.

FIGS. 2(A) and 2(B) shown partial sectional views of two examples of a thermal head 7*a*, 7*b* used for dye recording. In both thermal heads 7*a*, 7*b*, electrodes 22*a*, 22*b* and heating elements 8*a*, 8*b* are arranged on a heat-resistant substrate 21*a*, 21*b*. On the surface of the thermal head 7, a protection layer is formed in order to prevent the direct contact of the heating elements 8*a*, 8*b*, and the electrodes 22*a*, 22*b* with the ink (not shown). The electrodes 22*a*, 22*b* are formed in parallel, and each of the heating elements 8*a*, 8*b* makes contact with an electrode. In the first thermal head 7*a* shown in FIG. 2(A), the heating elements 8*a* are arranged on the end plane 23*a* of the thermal head 7*a*, while in the second thermal head 7*b* shown in FIG. 2(B), the heating elements 8*b* are arranged on a sloping plane 24*b* extending from an end plane 23*b* of the thermal head 7*b*. The heating elements may also be formed as bumps.

In a prior art thermal head of plane type, heating elements are arranged in the center of a plane substrate. Therefore, it is difficult to supply the ink because the entire plane of the thermal head has to make contact in order to make the ink on the surface of the dyed layer contact to the heating elements. On the contrary, if the thermal head 7*a*, 7*b* shown in FIGS. 2(A) and (B) according to the present invention are used, the end plane 23*a*, 23*b* can be pressed to the dyed layer 4 to remove almost all the ink 4 from the surface of the dyed layer and the ink on the surface of the dyed layer 3 is easily heated and a recording image of good image quality is obtained.

Figure 3:
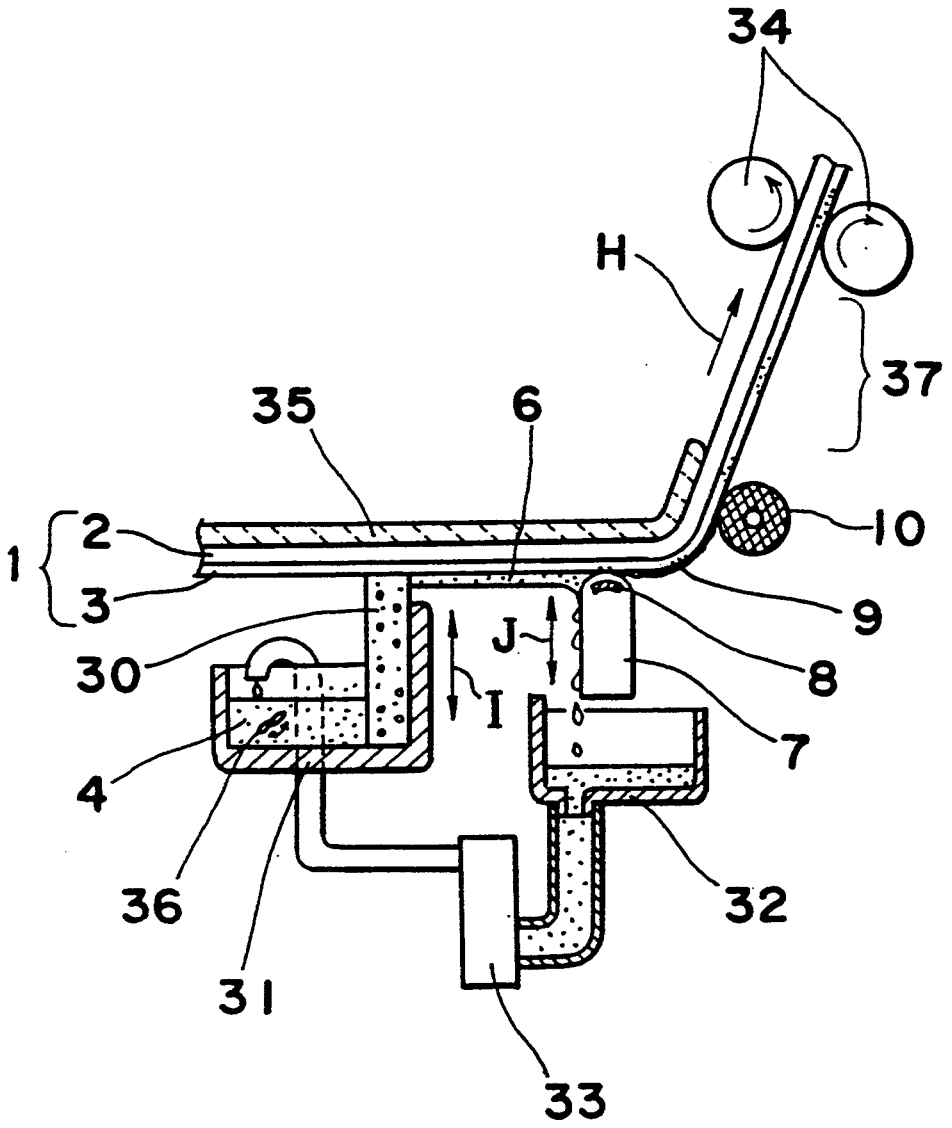
FIG. 3 is a schematic sectional view of a first example of a dye recording apparatus.

FIG. 3 shows a first example of a dye recording apparatus of the present invention schematically, wherein numeral 30 designates a porous body which can impregnate the ink 4, numeral 31 designates an ink supply tank for supplying the ink 4 to the porous body 30, numeral 32 designates an ink collection plate for collecting the ink removed from the surface of the dyed layer 3 with the thermal head 7, numeral 33 designates an ink pump for transferring the ink collected in the ink collection plate 32, numeral 34 designates a platen for carrying a recording medium in the direction of an arrow H, numeral 35 designates a plate which serves as a guide for the recording medium 1 and as a plate for receiving the pressure of the thermal head 7, and numeral 36 designates an ink stirrer for mixing the ink 4 in the ink supply tank 31.

In this example, an ink supplier consists of the porous body 30, the ink supply tank 31 and the ink stirrer 36. The ink is supplied to the recording medium 1 by the contact of the porous body 30 impregnated with the ink 4, and the ink fluid layer 6 is adjusted by the wire bar 5 in FIG. 1. An ink collector consists of the ink collection plate 32 and the ink pump 33. An ink remover includes the felt roller 10 mentioned above.

Next, the procedure of dye recording is explained. As shown in FIG. 3, the porous body 30 is dipped partially in the ink 4 contained in the ink supply tank 31, and the ink 4 impregnates the porous body 30. The porous body 30 can be moved in the vertical direction of an arrow I FIG. 3, while the thermal head 7 can be moved in the vertical direction of arrow J in FIG. 3. When the porous body 30 contacts the dyed layer 3, the ink 4 is supplied from the porous body 30 to form an ink fluid layer 6 due to the movement of recording medium 1 in the direction of an arrow H as a result of the rotation of the platen 34. Next, most of the ink 4 is removed by the thermal head 7 pressed to the dyed layer 3 and is collected in the ink collection plate 32. At this time, the heating elements 8 of the thermal head 7 are heated according to an image signal to dye the dyed layer 3 to reflect the positions of an image. Residual ink 9 remains on the surface of the dyed layer 3 after the passage of the thermal head 7, and the residual ink 9 is absorbed by the felt roller 10 to get a recorded image 37.

The ink 4 collected in the ink collection plate 32 is transferred by the ink pump 33 into the ink supply tank 31 for recycline. Thus, the running cost becomes lower.

Further, the ink is stirred by the ink stirrer 36 installed in the ink supply tank 31 in order to reduce a change in the density of recollected ink. If the amount of the dye included in the ink 4 in the ink supply tank 31 decreases substantially, dye or ink may be supplied to maintain the dye density at a constant level. For example, the transparent density or the like is measured, and if the amount of the ink decreases below a predetermined density, dye or ink is added.

The porous body 30 is made of a material which will not react with the solvent of the ink 4, such as polyurethane (trade name: RUBYCELL, Toyo Polymer Co., Ltd.), cellulose, polyethylene, or polyester or a mixture thereof, or a porous fiber of rayon, silk, acetate or the like with a binder such as acrylic resin.

Examples of dye recording with use of the dye recording apparatus shown in FIG. 3 will be explained in detail below.

A recording medium 1 used in the following Examples has a substrate 2 of 100 μm thickness of polyethylene terephthalate dispersed with white pigments (trade name: white PET U1, Teijin Ltd.), and a dyed layer 3 of 7 μm thickness applied to the substrate 2. The dyed layer 3 consists of 20 weight parts of polyester resin (trade name: Byron 200, Toyobo Co., Ltd.), 10 weight parts of acryl urethane silicon resin (trade name: UA53, Sanyo Chemical Industry, Ltd.) and 0.3 weight parts of hardening catalyst (trade name: Cat. FX, Sanyo Chemical Industry, Ltd.). The density of the paper sheet $D_R$ is 0.10.

The thermal head 7*a* of the structure shown in FIG. 2(A) is used in the apparatus, wherein the heating elements 8 are arranged with 125 μm pitch, and each heating element has about 100Ω of resistance (Matsushita Electronic Components Co. Ltd.).

EXAMPLE 1

The dye is made of indoaniline dye (melting point about 130° C.) which is a cyan color dispersion dye (Mitsubishi Kasei Corp.). Signals applied to the thermal head 7 have a period T of 16.7 ms, a maximum pulse width $Pw_{max}$ of 8 ms and an application voltage of 4 V. The recording medium 1 is carried at a speed of 125 μm per period.

Table 1 shows the relation of the solubility of solvent with recording characteristic. The ink 4 has a composition of 90 wt % of solvent and 10 wt % of dye, and the ink is prepared by dispersion with a ball mill.

TABLE 1

| | solution property | | recording characteristic | | |
|---|---|---|---|---|---|
| solvent | dye | dyed layer | recording? | maximum density | density when not heated |
| water | insoluble | insoluble | o | 1.1 | 0.10 |
| silicone oil | insoluble | insoluble | o | 1.5 | 0.10 |

TABLE 1-continued

| | solution property | | recording characteristic | | |
|---|---|---|---|---|---|
| solvent | dye | dyed layer | recording? | maximum density | density when not heated |
| ethanol | soluble | insoluble | o | 1.4 | 0.15 |
| octanol | soluble | insoluble | o | 1.4 | 0.15 |
| ethylene glycol | soluble | insoluble | o | 1.5 | 0.12 |
| propylene glycol | soluble | insoluble | o | 1.6 | 0.12 |
| toluene | soluble | soluble | x | — | — |
| acetone | soluble | soluble | x | — | — |

In Table 1, circle marks at the recording? column mean that a gradation recording is obtained, while x marks mean the gradation recording cannot be performed.

The silicone oil used as a solvent is dimethyl silicone of Shin-Etu Chemical Co., Ltd., and the viscosity is 20 mPa.s.

Table 1 shows that gradation recording can be realized when solvents which are not sulubte into the dyed layer 3 are used. In a solvent of low solubility of dye, the dye is dispersed like particles. Good recording characteristics can be realized for solvents such as water or silicone oil wherein the dye is not dissolved, but dispersed.

The data of density obtained without heating show that dyeing can be performed only by applying heat to the ink 4. The density $D_R$ of recording medium (paper sheet) 1 is 0.10. It is found that polyhydric alcohols such as ethylene glycol and propylene glycol are better than monohydric alcohols such as ethanol and octanol as to recording characteristics, and almost no fog is observed with naked eyes when polyhydric alcohols are used.

EXAMPLE 2

The ink 4 used in this Example consists of 20 weight parts of cyan dispersion dye (indoaniline dye, Mitsubishi Kasei Corp.) and 80 weight parts of propylene glycol. The dye almost dissolves in the solvent.

In order to compare a prior art sublimation type heat transfer recording, an ink sheet is made from a polyethylene terephthalate (PET) film of thickness 6 μm and an ink layer of 4 μm thickness. The ink layer includes 40 weight parts of polyvinyl butyral (trade name: BX-1, Sekisui Chemical Co., Ltd.) and 60 weight parts of cyan sublimation dispersion dye (trade name: Kayaset 714, Nippon Kayaku Co., Ltd.) and the ink layer is formed on the ink sheet with solvent coating technique. When this prior art ink sheet is used for the dye recording apparatus shown in FIG. 3, the sheet and a recording medium 1 are adhered beforehand, and the adhered composition heated with the thermal head 7. At this time, the porous body 30 has been removed.

The thermal head 7 is the same as used in Example 1. The application of image signals and the carriage of the recording medium 1 are performed in the same way as in Example 1.

Figure 4:
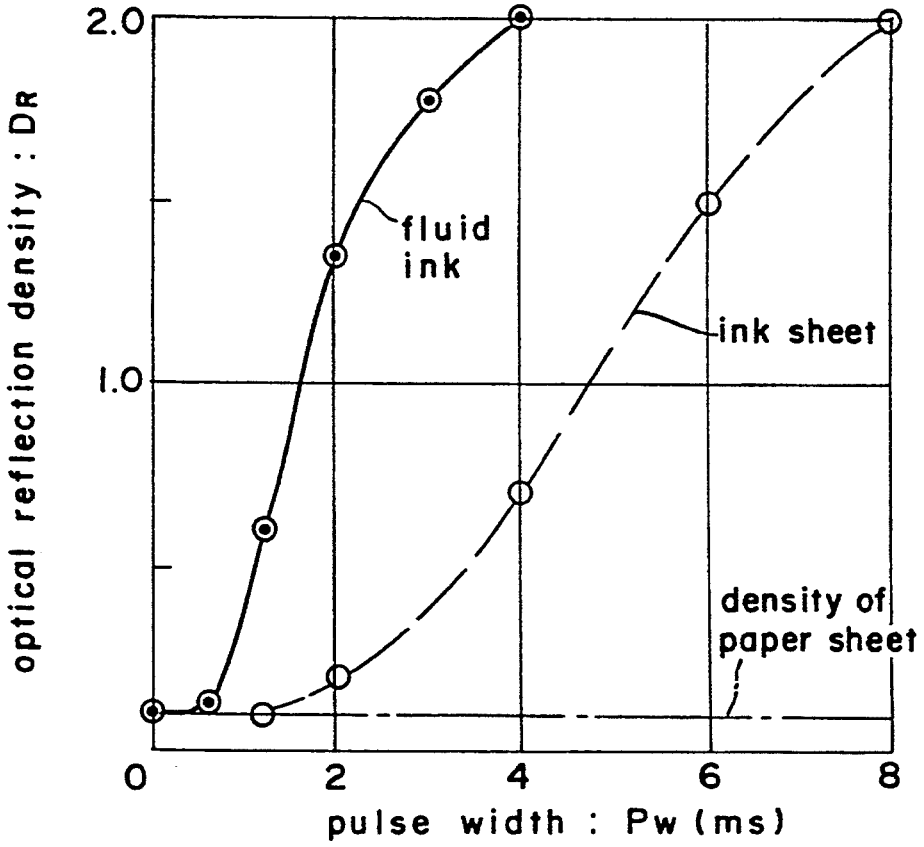
FIG. 4 is a graph of optical reflection density plotted against pulse width when fluid ink and ink sheet are used (Example 2)

FIG. 4 compares recording characteristics between fluid ink and an ink sheet. The abscissa designates the pulse width of a signal applied to the thermal head, while the ordinate designates optical reflection density. The density is measured with an instrument (Macbeth RD914). If the ink of fluid ink according to this invention is used, recording can be carried out at a pulse width lower than that for the ink sheet. Therefore, it is found that the recording sensitivity can be improved greatly.

Further, recording of maximum density of 1.8 or higher can be realized when the ink according to the present invention is used in the conditions wherein the period T is set to be 4 ms, the maximum pulse width $Pw_{max}$ is set as 2 ms and the applied voltage is set as 5 V. On the contrary, when the prior art ink sheet is used, recording cannot be performed because the PET film melts to adhere the thermal head when a voltage of 6 V or higher is applied. That is, in a dye recording method according to the present invention, because the ink is heated directly, recording can be performed at a lower energy and recording can be performed stably at a higher rate. On the contrary, in the prior art method with use of an ink sheet, the recording depends on the heat-resistant property of the sheet-like substrate.

EXAMPLE 3

Figure 5:
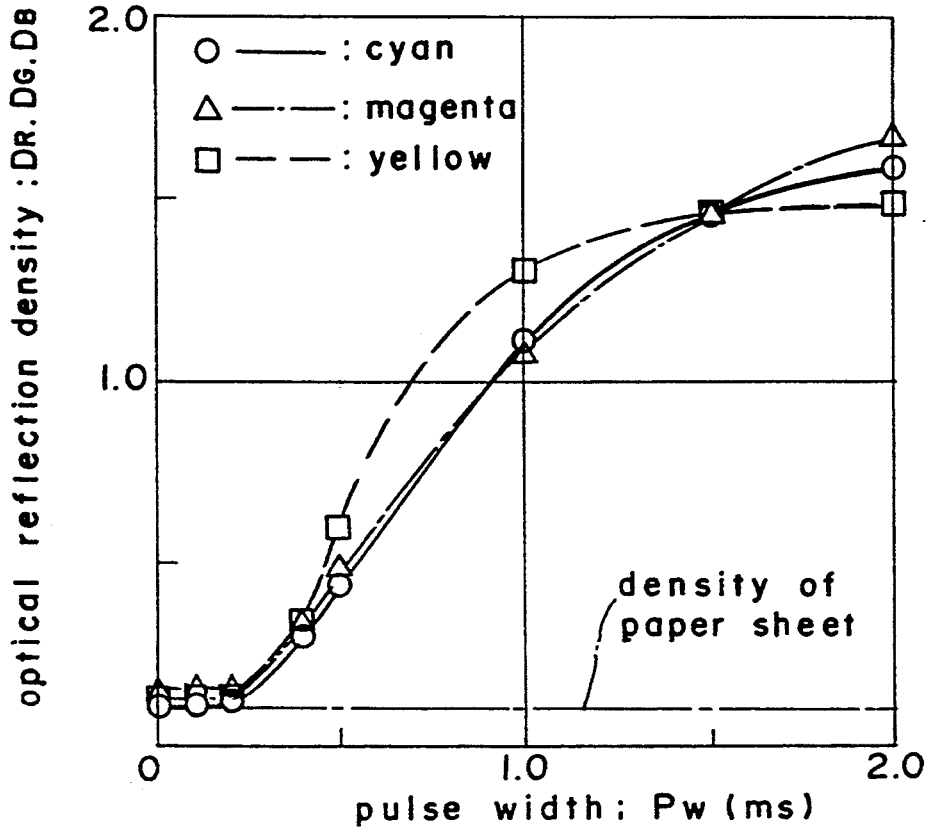
FIG. 5 is a graph of optical reflection density of three primary colors plotted against pulse width (Example 3)

FIG. 5 shows recording characteristics of a full-color image when inks of the three primary colors, cyan, magenta and yellow, are used. The ink of each color consists of 10 weight parts of dye of each of the three primary colors and 90 weight parts of propylene glycol. The cyan dispersion dye is an indoaniline dye, the magenta dispersion dye is an azo dye, and the yellow dispersion dye is an dicyanomethine, all from Mitsubishi Kasei Corp. The dye is almost dissolved in the solvent in each ink. Recording is performed in conditions of a period T of 4 ms, the maximum pulse width $Pw_{max}$ of 2 ms and an applied voltage of 5 V. Continuous, gradation recording can be realized for each ink of the three colors.

EXAMPLE 4

Figure 6:
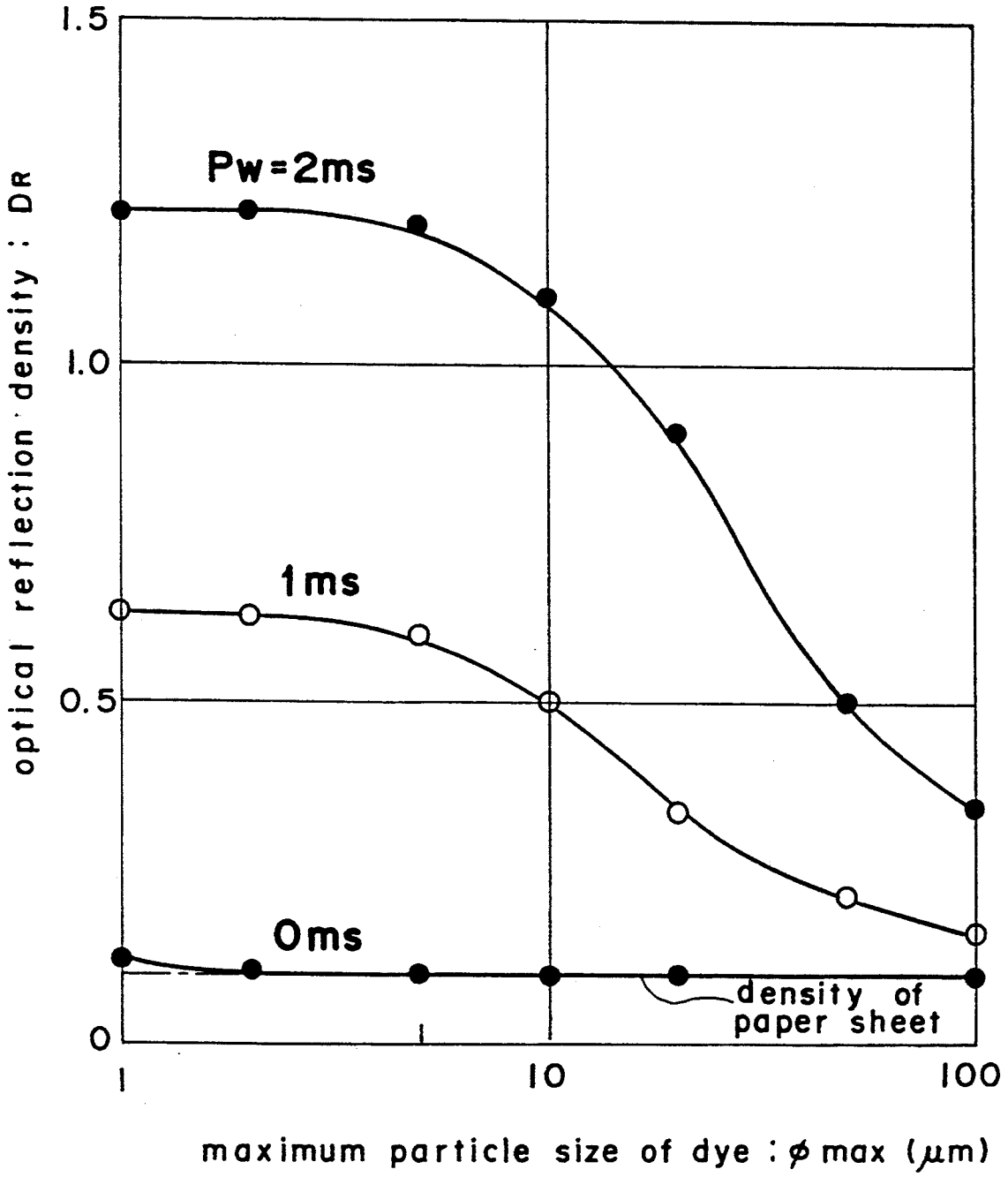
FIG. 6 is a graph of optical reflection density plotted against maximum particle size of dye when the dye is insoluble in water or a solvent (Example 4)

FIG. 6 shows a recording characteristic when an ink of cyan includes water or a solvent which does not dissolve the dye. The composition of the cyan ink is 10 weight parts of cyan dispersion dye (indoaniline dye, Mitsubishi Kasei Corp.) and 90 weight parts of water. The ink is prepared with a ball mill and the stirring time is changed in order to change the degree of dispersion. The abscissa designates the maximum particle size, while the ordinate designates recording density with use of ink. The pulse width applied to the thermal head 7 is a parameter. The dye has a shape between 0.1 to 0.2 mm thickness and $1\times1$ mm$^2$ area before the dispersion. The maximum particle size is determined with microscope observation.

Recording is performed in conditions of a period T of 4 ms, maximum pulse width $Pw_{max}$ of 2 ms and applied voltage of 5 V. Continuous, gradation recording can be realized in every case. However, when the maximum particle size increases over 50 μm diameter, a sufficient recording density is not obtained. On the other hand, it is found that a sufficient recording density can be obtained especially by reducing the maximum particle size to 20 μm or below.

When the ink 4 of maximum particle size of 10 μm diameter is used and the applied voltage is set to be 6 V, the ink boils if the pulse width increases up to 1.5 ms or above, and the recording becomes unstable. The movement of dye in the diffusion is more active with decrease in a moving unit of dye, and the melting of dye enhances the diffusion due to the weakening of force between dye molecules. It seems that dyeing cannot be performed sufficiently in this case because the melting point of the dye used is about 130° C. and the dye does not melt in the water solvent.

If 1 weight part of polyethylene glycol (#10000, Dai-ichi Kogyo Seisakusyo Co., Ltd.) is added to 10 weight parts of the ink, the boiling point of the ink increases a little, so that stable recording characteristic can be obtained even if the applied voltage is increased above 6 V. Further, as to inks including ethylene glycol (boiling point 198° C.) or propylene glycol (boiling point 187° C.) as a solvent, recording can be performed stably even if the applied voltage is increased, and a sufficient recording density can be obtained.

EXAMPLE 5

The ink consists only of a paste-like dye of copper phthalocyanine (trade name: HC-Blue-1, Hodogaya Chemical Co., Ltd.).

Figure 7:
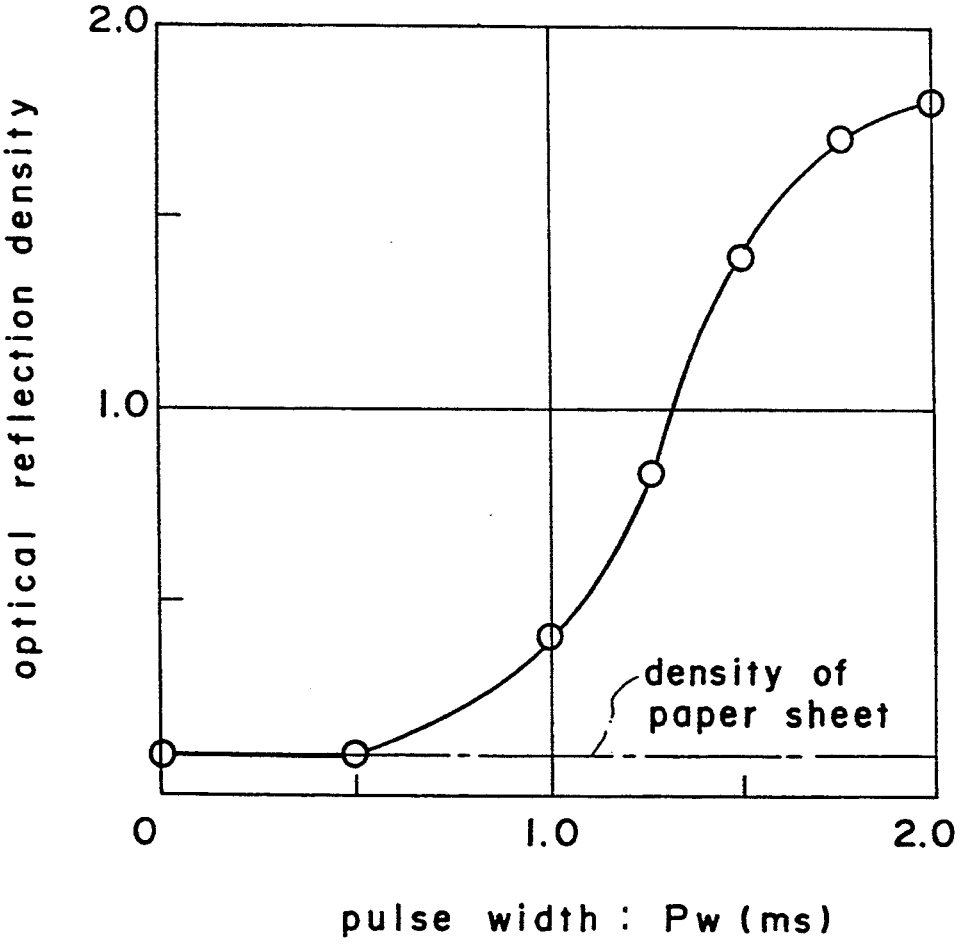
FIG. 7 is a graph of optical reflection density plotted against pulse width (Example 5)

FIG. 7 shows a recording characteristic of this ink. A fog is not observed, and gradation recording can be realized continuously from the density of paper sheet by controlling the pulse width of the image signal applied to the thermal head. The recording conditions are the same as in Example 2.

Figure 8:
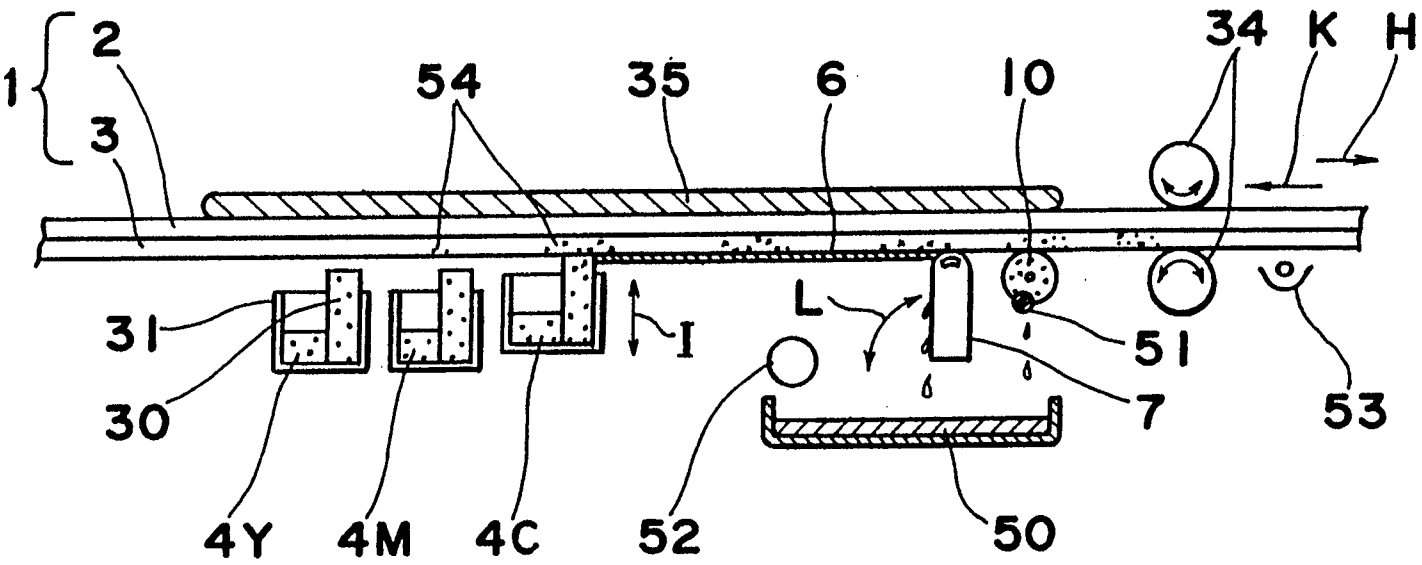
FIG. 8 is a schematic sectional view of a dye recording apparatus of a second embodiment.

FIG. 8 shows a second embodiment of a dye recording apparatus according to the present invention schematically. Numeral 50 designates an ink absorber for storing the ink 4 removed by the thermal head 7 or the like, numeral 51 designates a metallic bar for squeezing the ink 4 from the felt roller 10 which absorbs the ink 4 remaining after the passing of the thermal head 7, numeral 52 designates a head cleaner for cleaning the surface of the thermal head 7 when the thermal head 7 is separated from the surface of the dyed layer 3, and numeral 53 designates a heater for heating the dyed layer 3 which has been dyed. Inks of three primary colors are prepared as the ink 4, and numerals 4C, 4M and 4Y designate the ink of cyan, magenta and yellow, respectively.

The operation of the above-mentioned dye recording apparatus will be explained below. Three ink suppliers 31 contain cyan ink 4C, magenta ink 4M and yellow ink 4Y, and they are arranged in the direction of carriage of a recording medium 1. They move independently in the direction of an arrow I so as for the porous body 30 to make contact with the dyed layer 3, but only one porous body 30 can make contact with the dyed layer 3 at the same time.

FIG. 8 shows a state wherein dye recordings of yellow and magenta have been completed and dye recording of cyan is being performed to overwrite a cyan image on a lapped image 54 of yellow and magenta. The recording of yellow and magenta has been performed according to the procedures explained above. When recording of a first color (yellow) is completed, the platen 34 is moved in the direction of an arrow K to return to the initial state. At this time, the porous body 30, the thermal head 7 and the felt controller 10 are separated from the dyed layer 3. Then, recording of a second color (magenta) is performed similarly by changing the ink 4. In FIG. 8, recording of a third color (cyan) is shown. That is, a recording medium 1 is carried in the direction of an arrow H by rotating the platen 34, while the cyan ink 54C impregnated in the porous body 30 is supplied by the contact of the porous body 30 to the dyed layer 3 to form an ink fluid layer 6. When the cyan recording is completed, the dyed layer 3 is heated with the heater 53, and the dye not yet colored is dyed in a stable manner, while the surface of the dyed layer 3 deformed by the heating with the thermal head 7, can be smoothed, and a full-color image of high quality can be obtained.

When the thermal head 7 is separated from the dyed layer 3 in the direction of an arrow L, the thermal head 7 makes contact with a head cleaner 52 to clean the top of the thermal head 7. Therefore, the mixing of colors can be prevented when the ink 4 is changed.

A full-color image can be recorded by using the recording apparatus shown in FIG. 8 and the inks 4C, 4M and 4Y of three primary colors shown in FIG. 5.

The heating of the dyed layer 3 can also be performed when the recording of each color is completed. In this case, the recording characteristic of each color becomes stabilized because the surface of the dyed layer 8 is always smoothed, and an image of high quality can be obtained.

In the embodiment shown in FIG. 8, inks of three primary colors are used. However, a black ink may also be supplied.

The ink absorber 50 and the above-mentioned porous body 30 may contain a resin with highly water-absorptive properties such as acryl-vinyl copolymer, sodium acrylate polymer or starch-acrylate salt graft-copolymer, which substances can absorb a large amount of dye having water.

The head cleaner 52 may be the same as the above-mentioned felt roller 10. Further, a solvent which can dissolve the ink 4 may be applied in order to enhance the cleaning effect.

The heater 53 may be any heater which can heat the dyed layer 3. For example, a heat roller having heating elements inside may be used to make contact with the dyed layer 3.

The metallic bar 51 is used to squeeze the ink 4 contained in the felt roller 34 into the ink absorber 50 in order to collect the ink. The material and the shape of the metallic bar 51 are not limited.

Figure 9:
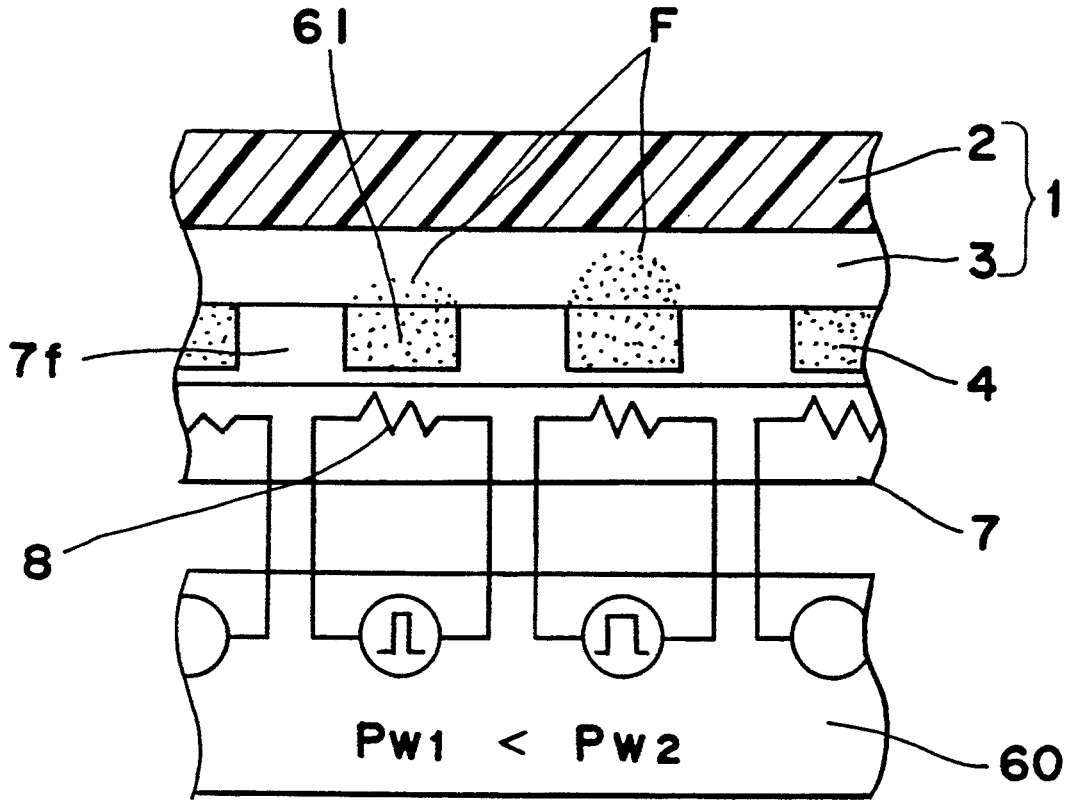
FIG. 9 is a schematic sectional view of a part of a dye recording apparatus of a third embodiment for showing the dyeing process.

Next, a dye printing embodiment of a third embodiment of the present invention will be explained with reference to FIGS. 9–11. FIG. 9 shows a schematic sectional view of a part of a dye recording apparatus of a third embodiment when dyeing is performed. Numeral 60 designates a signal source for controlling the supply of electric power to the heating elements 8. A thermal head 7 has an uneven coating film 7*f* to prevent the direct contact of the upper surface of the heating elements 8 with a recording medium 1, and the heating elements 8 are arranged with a predetermined pitch in the direction parallel to the plane of the paper on which FIG. 9 is drawn. On the other hand, the protection film 7*f* is formed as uneven heaps, so that there are grooves between the heaps above the surface of the heating elements 8 (refer FIG. 11). The grooves play a role as liquid passages 61 allowing fluid ink 4 to flow in the direction perpendicular to FIG. 9.

In the above-mentioned embodiment, the pressure of the thermal head 7 against the recording medium 1 is controlled so that the grooves above the surface do not directly contact the dyed layer 3. When recording is performed, the thermal head 7 is pressed to the dyed layer 3 while the ink 4 is held in the liquid passages 61 of the coating film 7*f*. When heating is performed, diffusion F occurs according to the amount of applied heat resulting in selective dyeing.

When heating elements 8 are not heated, the diffusion of dye is insubstantial and the dye does not diffuse into the dyed layer 3, or dyeing is not performed. The signal source 60 controls the pulse width for varying the electric power applied to the heating elements 8. In FIG. 9, electric impulses of pulse widths $Pw_1$ and $Pw_2$ ($Pw_1 < Pw_2$) are shown to be supplied to two heating elements 8. For a longer pulse width $Pw_2$, the diffusion F of the dye becomes greater.

Further, a recording medium 1 travels in to a direction perpendicular to FIG. 9 to supply fresh ink 4 to the liquid passages 61. Thus, a constant amount of fresh ink 4 can always be held in the liquid passages 61, and recording with density more uniform than Examples 1 and 2 can be obtained.

Figure 10:
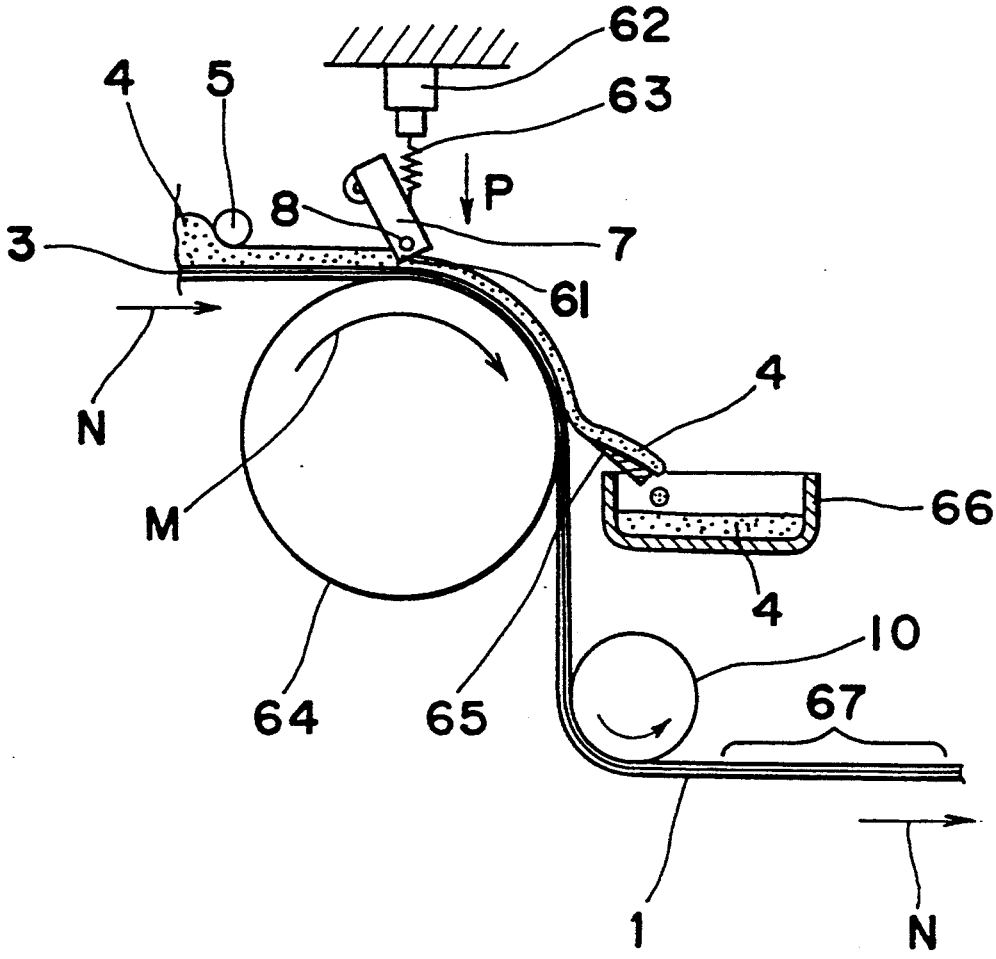
FIG. 10 is a schematic sectional view of the dye recording apparatus.

FIG. 10 displays a schematic sectional view of the dye recording apparatus, wherein numeral 62 designates a plunger operated with electric power as an example of pressing means for pressing the thermal head 7 to a recording medium 1 via a spring 63, numeral 64 designates a platen roller as an example of carriage means for carrying the recording medium 1 with the ink 4 on the surface, numeral 65 designates a blade as an example of ink removing means for removing the ink 4 from the surface of the recording medium 1, and numeral 66 designates an ink collection container for collecting the ink 4 removed from the surface of the recording medium 1.

At the top of the thermal head 7, many heating elements 8 are arranged with a predetermined pitch in the direction perpendicular to the plane of the paper on which FIG. 10 is drawn, while the coating film 7*f* applied to the surface of the heating elements 8 form liquid passages 61 in the direction parallel to FIG. 10 (refer FIG. 9).

The operation of the dye recording apparatus displayed in FIG. 10 will be explained below. First, a recording medium 1 is carried in the direction of an arrow N accompanied by the rotation of the platen roller 64 in the direction of an arrow M, while a constant amount of ink 4 is supplied by the wire bar 5 to the surface of the recording medium 1. Next, in order to prevent the direct contact of the bottoms of the liquid passages 61 of the thermal head 7 with the recording medium 1, the ink 4 is held in the liquid passages 61 by pressing the thermal head 7 over the ink 4 with the plunger 62 via the spring 63 in the direction of an arrow P.

At the point where the thermal head 7 is pressed to the recording medium 1 (the pressing area), dyeing of the dyed layer 3 is performed by supplying electric power to the heating elements 8 with the signal source 60 (refer FIG. 9). Then, the ink 4 remaining on the surface is removed with the blade 65, and the ink 4 is collected in the ink collection container 66. Further, the surface is wiped with the felt roller 10 to obtain a recording image 67.

This apparatus can supply new ink in a constant amount always by using the ink supply with the wire bar 5 and the carriage of the recording medium 1, and a recording of good quality can be obtained without non-uniformity of density. The ink 4 is recycled so that the running cost may be lowered. The ink 4 is supplied through the liquid passages 61 of the thermal head 7 (not shown) in the same direction as the carriage of recording medium. Therefore, it is not needed to supply the ink 4 with pressure, and the structure of the apparatus can be simplified.

Further, the blade 65 should be pressed against the recording medium 1 without damaging the dyed layer 3, and is made from a material which is not reactive with the ink 4 such as a metallic plate of stainless steel, copper or the like, a resin plate of polyethylene, polyester or the like, or a rubber plate of urethane rubber, nitrile rubber, fluorine rubber or the like.

The blade 65 is used to remove the ink 4. Instead of providing the blade 65, the ink removal can be performed for example by blowing gas such as air, by pressing an ink-absorbing porous body or a cloth, or by dipping for cleaning in a solvent which does not react with the dyed layer 3.

Figure 11:
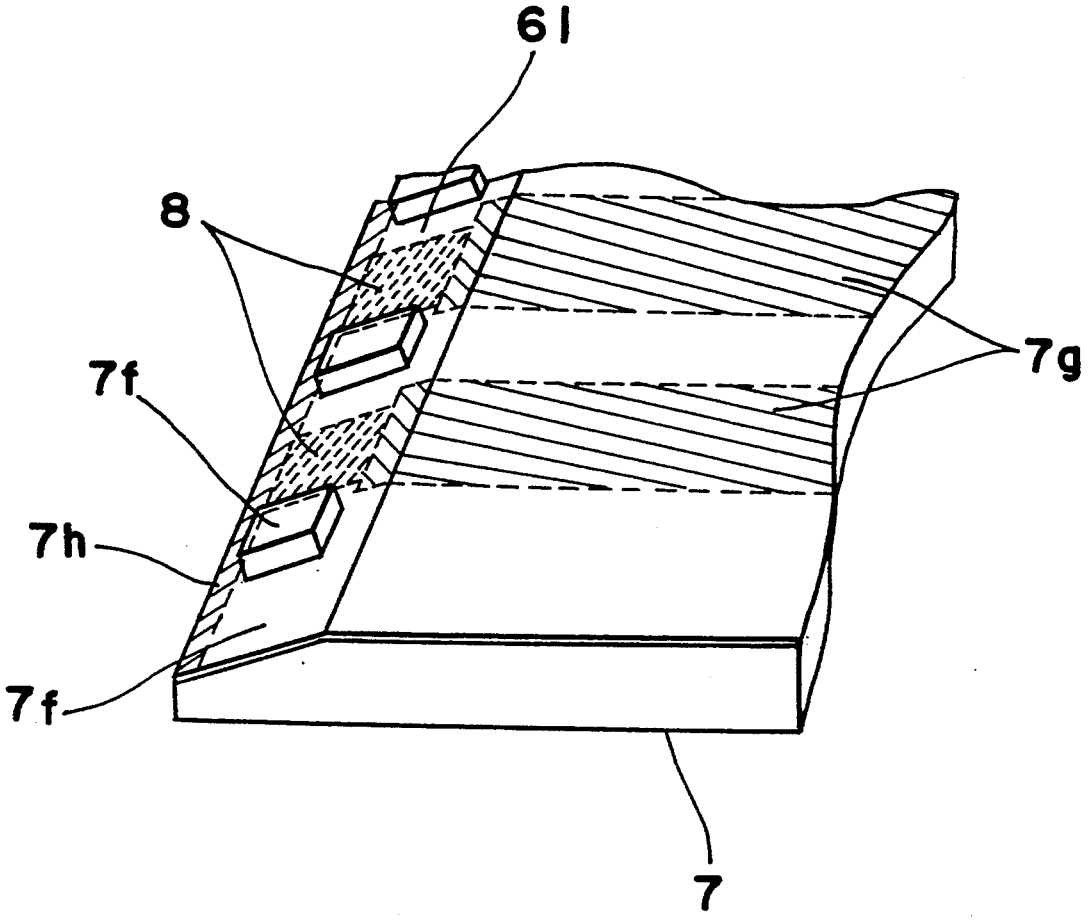
FIG. 11 is a partial sectional view of a thermal head used in the dye recording apparatus.

FIG. 11 shows partially a thermal head 7 used in the dye recording apparatus of the third embodiment. Numeral *7g* designates a recording electrode for providing signals to the heating elements 8 for heating, while numeral *7h* designates a common (return) electrode for providing the return path of electricity, and is connected to the heating elements 8. Heating elements 8 are formed on a slope plane at the top of the thermal head 7 as the thermal head shown in FIG. 2(*b*), connected and are to the recording electrodes *7g*. The coating layer *7f* forms heaps above the surface between the heating elements 8, while the surface over the heating elements 8 becomes groove portions. Thus, liquid passages 61 which can hold the ink are formed over the heating elements 8. In FIG. 11, the heating elements 8, the recording electrodes *7g* and the common electrode *7h* are displayed with dashed lines because they are covered with the coating layer *7f*. Even if the thermal head 7 is pressed to a recording medium 1, the heap portions serve as spacers so as to secure the spaces for holding a constant amount of ink in the liquid passages 61.

EXAMPLE 6

As shown in FIG. 11, a thermal head 7 is manufactured as follows: Heating elements 8 of $Ta_2N$, and recording electrodes *7g* and a return electrode *7h* both of Au are formed on an alumina substrate, both covered by a protection layer *7f* of $SiO_2$ of 15 μm thickness. Then, etching with fluorine acid is performed so as to make the height of the heap portions 10 μm. That is, the protection layer *7f* of 5 μm is formed on the heating elements 8 in the groove portions. In this thermal head 7, the resistance of the heating element 8 is about 800Ω, and the heating elements 8 are arranged at a density of 6/mm.

As shown in FIG. 10, the pressure of the platen roller 64 against the thermal head 7 is about 1.5 kg/line. The recording signals for the heating elements 8 are modulated as to pulse duration, and the maximum pulse width applied to a heating element 8 is 4 ms and the applied voltage is 15 V. A recording medium 1 used in following Examples has a substrate 2 of white PET film (trade name: white PET-U6, Teijin Ltd.) of 80 μm thickness of polyethylene terephthalate, while a butyral resin layer (trade name: BMS, Sekisui Chemical Co., Ltd.) as a dyed layer 3 of 10 μm thickness is formed on the white substrate 2. The ink 4 is prepared by mixing 80 weight parts of propylene glycol and 20 weight parts of cyan dye of indoaniline (Mitsubishi Kasei Corp.). Under these recording conditions, a recording image 67 of sufficient density can be obtained. That is, a density between the paper sheet density 0.10 and a maximum density 2.10 can be realized, and the recording image 67 has minor density nonuniformity and good gradation property.

As explained above, the thermal head 7 according to the present invention has heap portions in a direction crossing the array of the heating portions. Thus, when the thermal head 7 presses the dyed layer 3, a constant amount of the ink 4 can always be held by keeping the ink 4 in the groove portions of the surface, and a recording image of good image quality is obtained. The heating portions are usually in the form of heating elements 8 heated by the application of electric power and one or a plurality of protection layers applied to the surface of the heating elements 8. Therefore, the thermal head 7 makes contact directly with the ink 4 through the protection layers.

Figure 12:
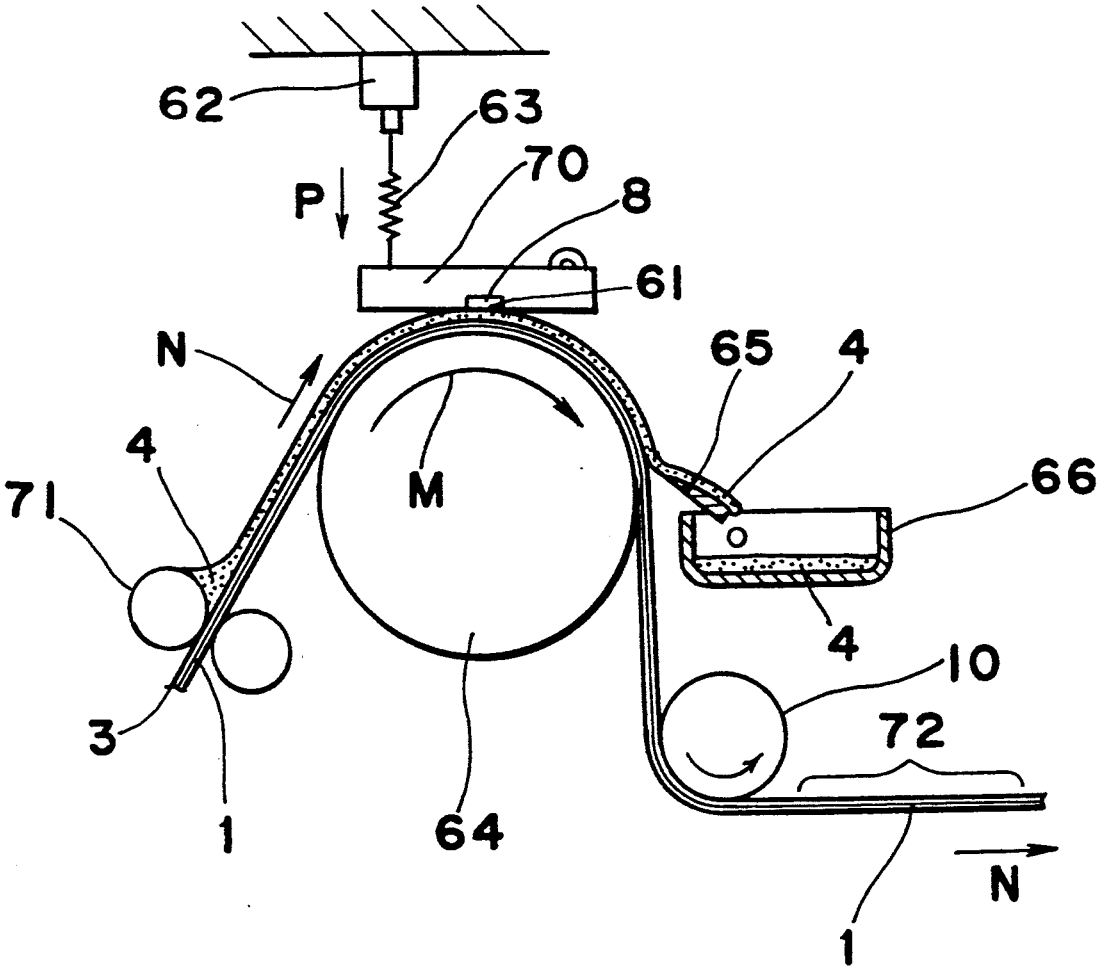
FIG. 12 is a schematic sectional view of a dye recording apparatus of a fourth embodiment.
Figure 13:
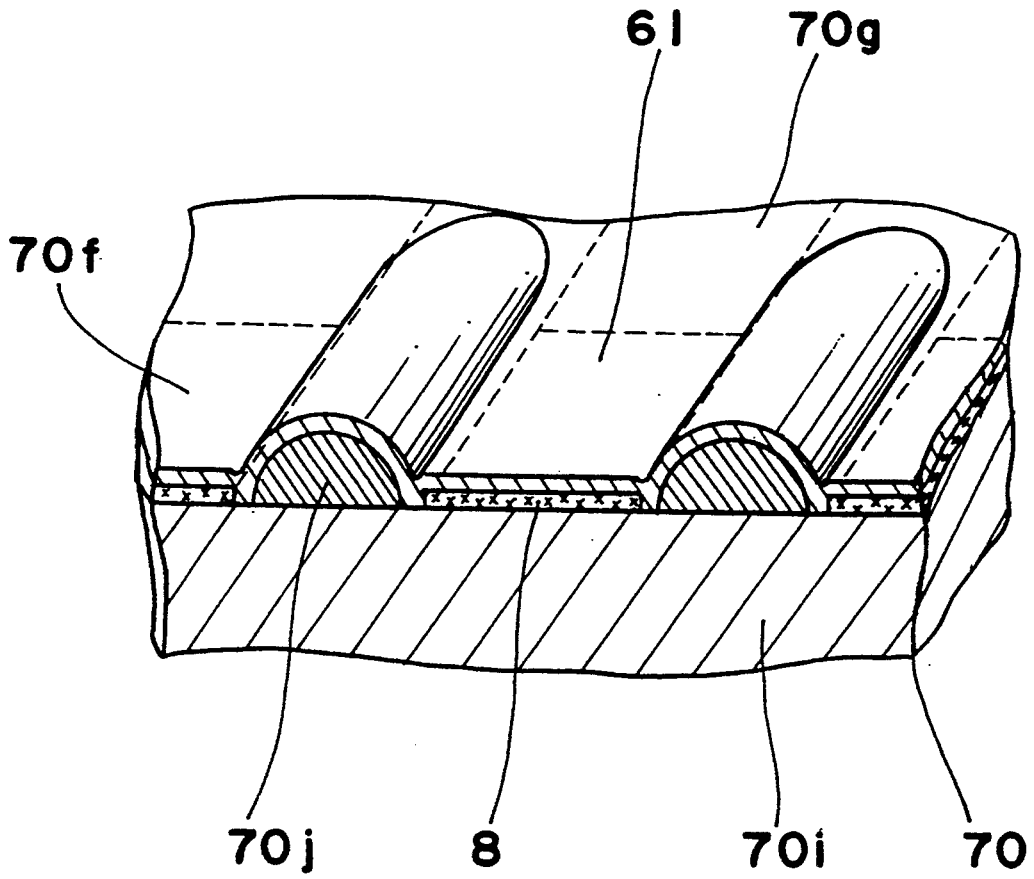
FIG. 13 is a partial sectional view of a thermal head used in the dye recording apparatus.

FIG. 12 shows a schematic sectional view of a dye recording apparatus of a fourth embodiment, and FIG. 13 shows a partial sectional view of a thermal head used in the dye recording apparatus. In FIG. 12, numeral 70 designates a plane type thermal head, and as shown in FIG. 13, the thermal head 70 has heating elements 8 in the central area of a substrate and a coating layer 70*f* of uneven surface is formed on the surface in order to prevent direct contact of the top surface of the heating elements 8 with the recording medium 1. Numeral 71 designates an ink applier for supplying the ink 4 to the surface of a recording medium 1 uniformly. The heating elements 8 are arranged with a predetermined pitch in the direction parallel to the plane of FIG. 12. The surface of the thermal head 70 is not even and forms dips on the surface over the heating elements 8, and the dips play a role as liquid passages 61 for the fluid in the direction perpendicular to the plane of FIG. 12.

The recording operation of the apparatus shown in FIG. 12 will be explained below. First, a recording medium 1 is carried in the direction of an arrow N accompanied by the rotation of a platen roller 64 in the direction of an arrow M, while a constant amount of ink 4 is supplied by the ink applier 71 to the surface of the recording medium 1. Next, the ink 4 is held in the liquid passages 61 formed by pressing the thermal head 70 over the ink 4 with a plunger 62 in the direction of an arrow P. At the pressing area, the dyed layer 3 is dyed by supplying electric power to the heating elements 8 from a signal source 60 (refer FIG. 9). Then, the ink 4 remaining on the surface is removed with a blade 65 to collect the ink 4 in an ink collection container 66. Finally, the surface is wiped with a felt roller 10 to obtain a recording image 72.

In this apparatus, the ink 4 is maintained a constant level and 4 is held in the liquid passages 61 of the thermal head 70. Therefore, a recording image 72 of high quality with minor density nonuniformity can be obtained.

The semicircular heaps of the thermal head 70 (see FIG. 13) are formed so that the height from the bottom of the liquid passages 61 is between 1 and 50 μm. If the height is less than 1 μm, enough ink to secure a sufficient density cannot be held, while if the height is over 50 μm, the heating efficiency at an interface area with the surface of the dyed layer 3 becomes too low and the recording sensitivity and resolution decrease due to the insufficient thermal conduction, so as to degrade the image quality largely.

Further, in the third and fourth embodiments, a uniform ink fluid layer is formed on the surface of the dyed layer 3 with the wire bar 5 (referring to FIG. 10) or with the ink applier 71, and then the thermal head 7 (referring to FIG. 10), is pressed to the surface of a recording medium 1. However, it is not needed to form a uniform ink fluid layer because the ink 4 is restricted only in the dip portions on the surface by the pressing.

For example, a predetermined amount of the ink may be dropped down on the surface of a recording medium 1 before the thermal head 7 (referring to FIG. 10) presses the surface.

Further, the ink 4 is supplied on the surface of the dyed layer 3 with the wire bar 5 (FIG. 7) or with the ink applier 71 (FIG. 12). However, a known applier such as a spray-type coating machine, a gravure roll coating machine, a reverse roll coating machine or a blade coating machine may also be used.

FIG. 13 shows a partial sectional view of the thermal head 70 used in the dye recording apparatus of the fourth embodiment. Numeral 70*f* designates a protection layer of the surface of the thermal head 70, numeral 70*g* designates a recording electrode for providing an electric path with a return electrode (not shown) for each heating element 8, numeral 70*i* designates a substrate of the thermal head 70, and numeral 70*j* designates a heap forming member for making the surface nonuniform. In FIG. 13, after the heap forming members 70*j* are formed on the substrate 70*i* with a predetermined pitch, the heating elements 8, the recording electrodes 70*g*, the return electrode and the protection layer 70*f* are applied to form liquid passages 61. The heating elements 8 and the signal electrodes 70*g* are displayed with dashed lines because they are covered with the protection layer 70*f*. Even if the thermal head 70 is pressed to the surface, the semicircular heap portions 70*j* of the surface serve as spacers to form spaces for holding a constant amount of ink in the liquid passages 61.

In FIG. 13, the heating elements 8 are arranged between the heap-forming members 70*j*. However, a part of the heating elements 8 may be arranged on the heap-forming member 70*j*.

EXAMPLE 7

In FIG. 13, a thermal head 70 is manufactured as follows: A low melting point glass is formed on the substrate 70*i* of alumina with thick film printing and it is fired to form heap-forming members 70*i* of about 20 μm of height. Further, heating elements 8 of $Ta_2N$, and recording electrodes 70*g* and a return electrode (not shown) both of Au are layered on an alumina substrate 70*i*, and a protection layer 70*f* of $SiO_2$ is layered, successively with a thin film technique. The final height of the heaps on the surface of the thermal head 70 is about 18 μm. In this thermal head 70, the resistance of the heating element 8 is about 850Ω, and the arrangement density of the heating elements 8 is 6/mm.

The pressure of the thermal head 70 against the platen roller 64 (FIG. 12) is about 1 kg/line. The recording signal for the heating elements 8 is modulated as to pulse duration, and the maximum pulse width applied to the heating element 8 is 4 ms and the applied voltage is 15 V. A recording medium 1 and ink 4 are the same as in Example 6. Under these recording conditions, a recording image 72 of sufficient density, up to a maximum density of 2.3 can be obtained with small density nonuniformity.

Figure 14:
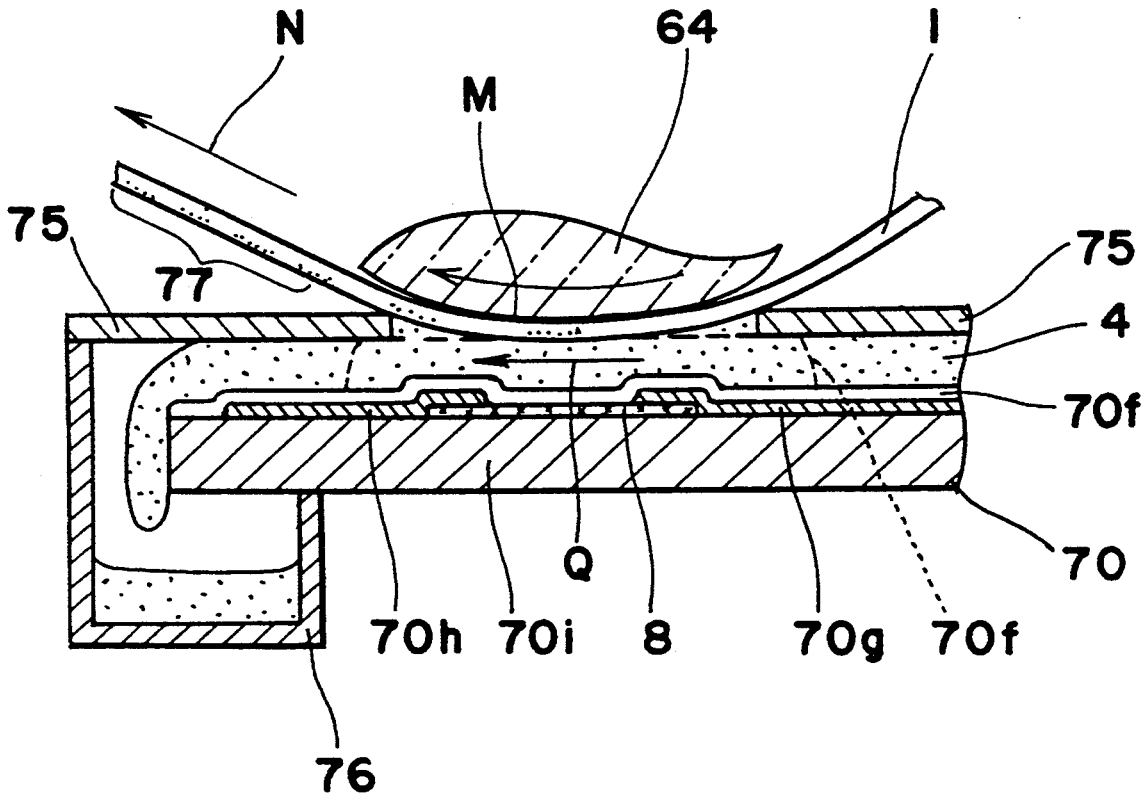
FIG. 14 is a partial schematic sectional view of a dye recording apparatus of a fifth embodiment.

FIG. 14 is a partial schematic sectional view of a dye recording apparatus of a fifth embodiment. A return electrode 70*h* is displayed explicitly, while the heap portions 70*f* of the protection layer 70*f* of a thermal head 70 are displayed with a dashed line because it is shaded with the ink 4 in this section shown in FIG. 14. Numeral 75 designates a cover plate to make contact with the heap portions 70*f* of the protection layer 70*f* of the thermal head 70 in order to prevent the contact of the ink 4 with a recording medium 1 except the pressing area. Numeral 76 designates an ink collection box for collecting the removed ink. Liquid passages 61 are formed on the surface of the thermal head 70 the direction in parallel to the plane of FIG. 14.

The recording operation of the apparatus shown in FIG. 14 will be explained below. First, a recording medium 1 is carried in the direction of an arrow N accompanied by the rotation of the platen roller 64 in the direction of an arrow M, while the recording medium 1 is pressed to the thermal head 70. The ink 4 is moved in the spaces formed between the heap portions 70*f* on the surface of the thermal head 70 and the cover plate 75, in the direction of an arrow Q. The cover plate 75 does not exist at the pressing area, wherein the dyed layer 3 of the recording medium 1 is dyed by supplying electric power to the heating elements 8 by the signal source 60 (not shown, refer FIG. 9). Then, the ink 4 remaining on the surface is removed with the cover plate 75 which acts also as a blade to collect the ink 4 in the ink collection box 76, and a recording image 77 is obtained finally.

In this embodiment, the ink 4 is not supplied to a recording medium 1 before reaching the pressing area, and the ink 4 is supplied directly in the liquid passages. Therefore, not only a recording of good image quality can be obtained, but also fog due to the contact with the ink 4 is reduced because the contact time is short. Further, the apparatus can be made compact easily. The maintenance of the apparatus becomes easy because the portion wherein the ink 4 is exposed becomes narrower so that mixing of dust with the ink 4 is reduced.

The ink collection box 76 is made from a chemically stable material such as a metal of stainless steel, copper or the like and a resin such as polyamide, polysulfone or the like. The collected ink 4 can be recycled easily for example by adding dye. At the recycling; a sensor which can detect the density of the ink 4 such as a transmission type photosensor may be used to judge whether to recycle the ink or not.

EXAMPLE 8

The thermal head 70 manufactured in Example 7 is used in the dye recording apparatus according to the fifth embodiment, and a nickel plate of 30 μm thickness having a slit-like hole over the heating elements 8 is adhered to the thermal head 70 in order to limit the contact of the ink 4 with air. Then, the amount of dust in the ink migrating from air can be reduced to a minimum. Therefore, the elimination of dust from the ink for recycling becomes easy, and the choking of fluid passages due to dust can be prevented to stabilize ink supply. Further, leakage of ink from the liquid passages can be prevented.

Further, the ink collection box 76 is attached at an end of the thermal head 70. The ink 4 is sent from the side of the recording electrodes 70*g* under pressure. The recording medium 1 and the ink 4 are the same as used in Example 6. Under these conditions, a half-tone image of sufficient density of small density nonuniformity can be recorded well. Even if a blade 65 is not used as in Examples 6 and 7, almost all ink 4 can be removed from the recording medium 1.

Figure 15A:
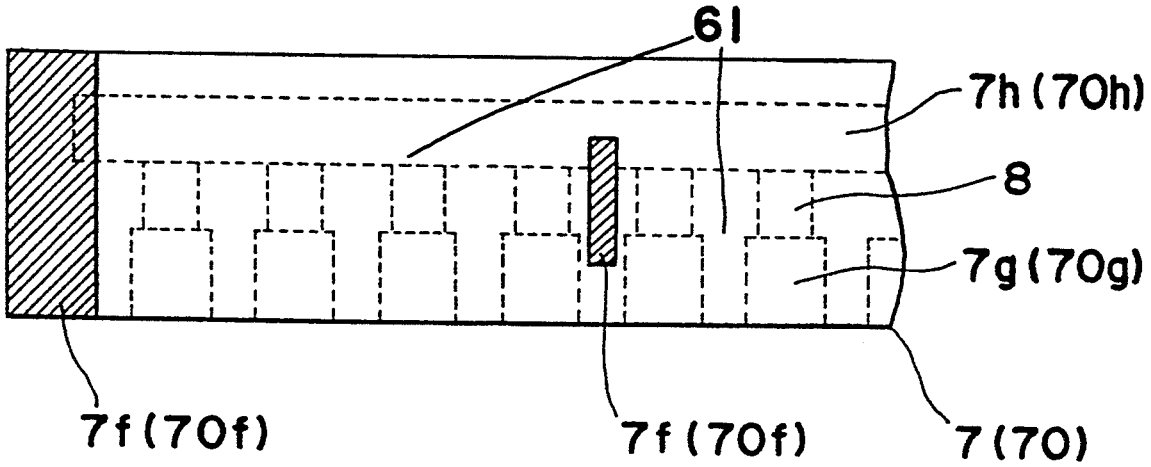
FIGS. 15(A), (B) and (C) are schematic diagrams of an area around the heating elements of a thermal head which can be used for the third, fourth and fifth embodiments.

FIGS. 15(A), (B) and (C) show partial sectional views of a thermal head 7 (70), which can be used in the dye recording apparatuses of the third, fourth and fifth embodiments, around heating elements 8, viewed above the protection layer 70*h*. The hatched portions display heap portions of the protection layer 70*f*. The heating elements 8, the recording electrodes 7*g* (70*g*) and the return electrode 7*h* (70*h*) are displayed with dashed lines because they are covered with the protection layer 70*f*.

As shown in FIGS. 15(A), (B) and (C), the heap portions at the surface of a slope plane 24 of the thermal head 7 (70) may be arranged and formed in combination with various kinds of patterns. The characteristic of the heap portion patterns will be explained below.

In FIG. 15(A), a heap portion (displayed as a hatched area as mentioned above) is formed in correspondence with each heating element 8. Therefore, as explained above, the ink can flow more easily and the choking of the ink in the liquid passages is reduced when compared with the case where heap portions are formed between heating elements 8. Thus, the maintenance of the apparatus becomes easy.

Figure 15B:
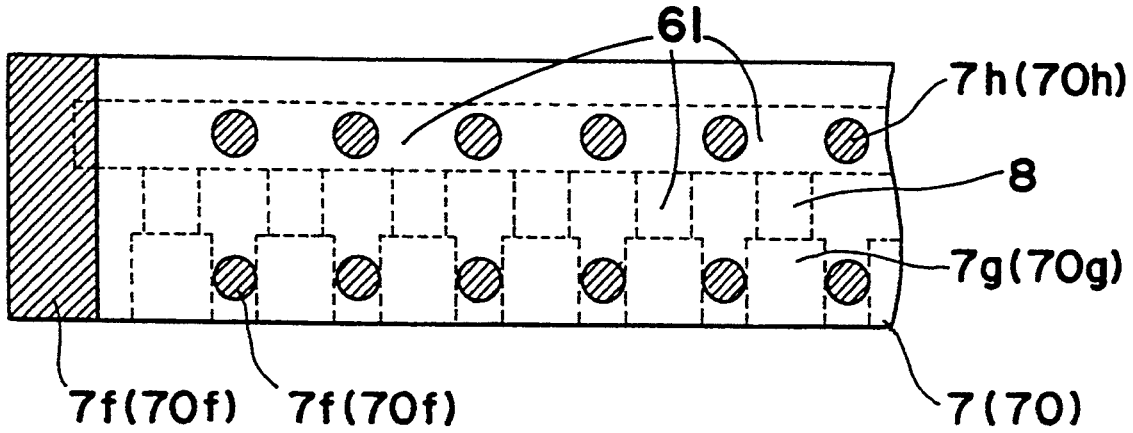

In FIG. 15(B), heap portions are formed in areas away from portions directly between heating elements 8 so that an array of the heating elements 8 is interposed between two arrays of the heap portions. Then, as explained above, no heap portions are formed between the heating elements 8, and the same amount of the ink can be heated. Thus, an image recording quality is improved and maintenance becomes easy.

Figure 15C:
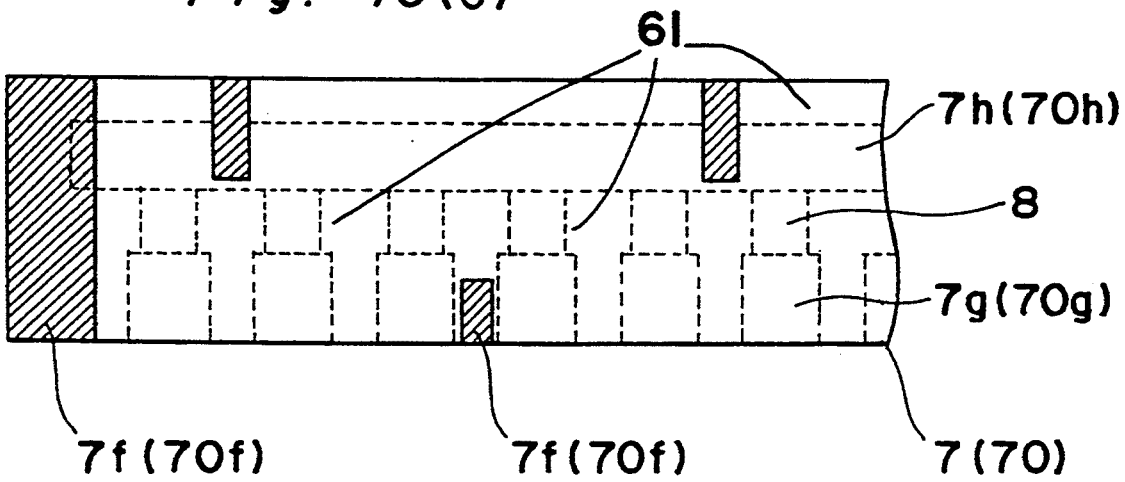

In FIG. 15(C), heap portions are arranged in areas away from portions directly between the heating elements 8 for a plurality of heating elements 8, and the heap portions are arranged alternately so as to interpose an array of the heating elements 8. Then, as explained above, no heap portions are formed between the heating elements 8, and the same amount of the ink can be heated. Thus, image recording quality is improved and the maintenance becomes easy.

In FIG. 15, heap portions are formed in areas away from portions between the heating elements 8. However, for example, heap portions may be formed in an extended area except just above the heating elements 8, or many small heap portions may be arranged on the surface irrespective of the positions of the heating elements 8.

The heap portions at the surface of the thermal head 7 (70) may be manufactured by adhering a material for forming them such as a resin material or a ceramic on the protection layer 7 (70).

In FIGS. 13 and 15, the liquid passages 61 on the surface of the thermal head 70 are formed in a direction perpendicular to the array of the heating elements 8. However, the liquid passages 61 may be formed in a direction for example crossing the array obliquely.

Next, a dye recording method and a dye recording apparatus according to the present invention will be explained below wherein a prior art thermal head having a flat surface above the heating elements is used and heat-resistant particles are mixed in the ink.

Figure 2:
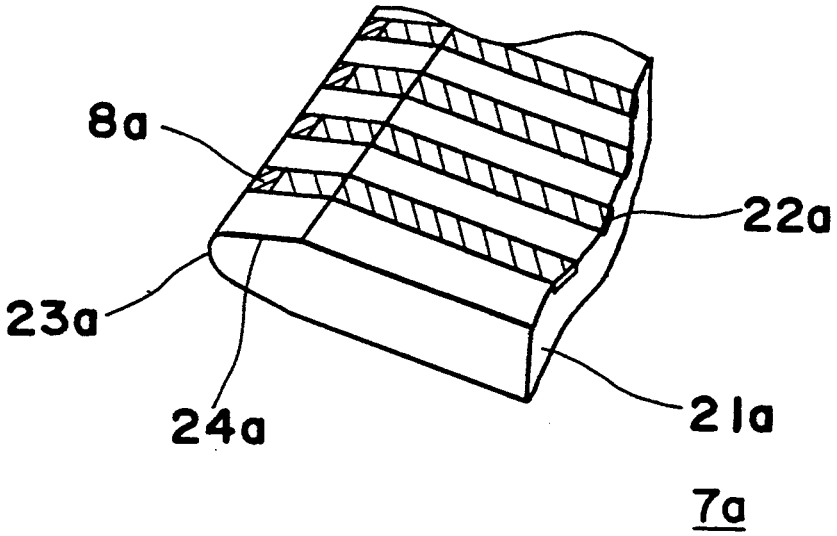
FIGS. 2(A) and (B) are partial sectional views of thermal heads.
Figure 2:
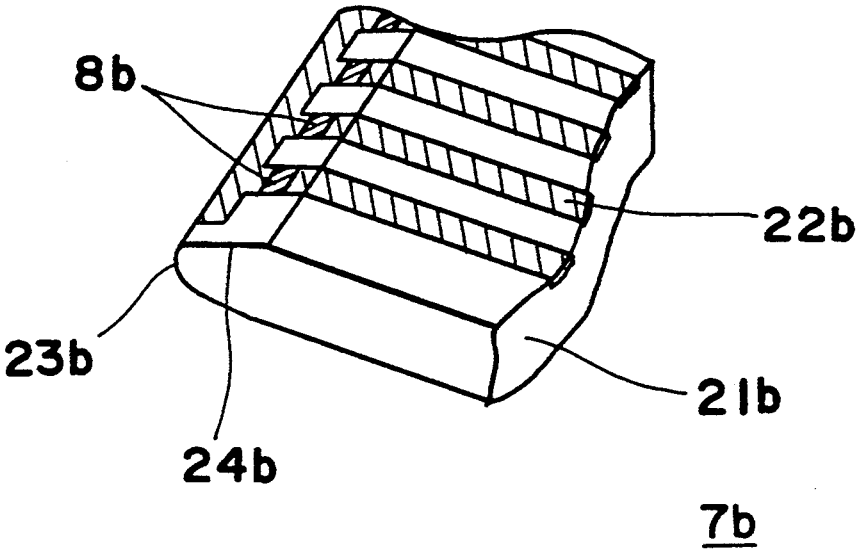
Figure 16:
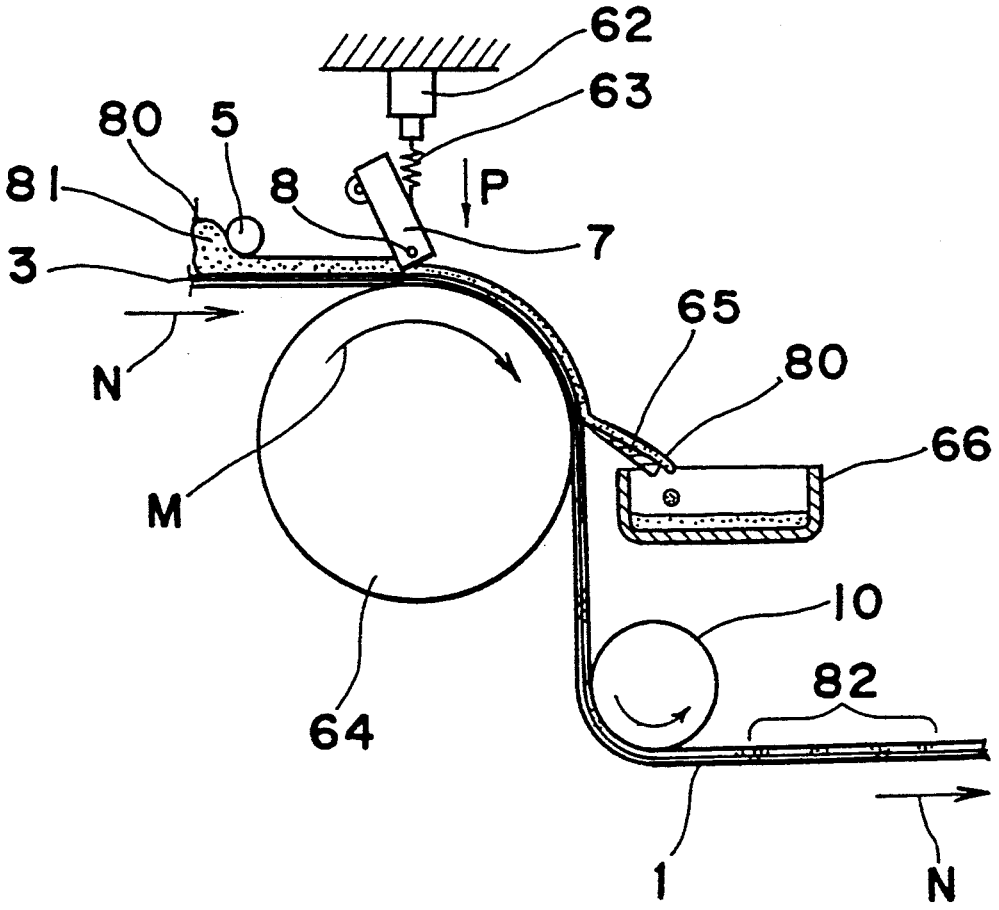
FIG. 16 is a schematic sectional view of a dye recording apparatus of a sixth embodiment.

FIG. 16 is a schematic sectional view of a dye recording apparatus of a sixth embodiment. Numeral 80 designates a particle-mixed ink including heat-resistant particles 81 as a fluid ink for dye recording. A thermal head 7 has a surface not so uneven, as shown in FIGS. 1 and 2. The basics of the recording apparatus are the same as that shown in FIG. 10. At the top of the thermal head 7, many heating elements 8 are arranged at a predetermined pitch, as shown in FIG. 2, in a direction perpendicular to the plane of FIG. 16.

Next, the recording procedure in this embodiment will be explained below. A recording medium 1 is carried in the direction of an arrow N accompanied by the rotation of a platen roller 64 in the direction of an arrow M. The particle-mixed ink 80 on the surface of a dyed layer 3 of a recording medium 1 is controlled to have a constant thickness with the wire bar 5. Then, the thermal head 7 is pressed by a plunger 62 with a spring 63, and the thermal head 7 presses the particle-mixed ink 80 on the surface of the dyed layer 3 at a pressure P. In this state, the heat-resistant particles 81 play a role as spacers, and the ink 80 of a thickness according to the particle size of the heat-resistant particles 81 is held between the thermal head 7 and the dyed layer 3. Then, the particle-mixed ink 80 is heated selectively by supplying electric power to the heating elements 8 according to the image signal. Thus, the dye included in the ink diffuses into the dyed layer 3 to form a recording image 82.

Then, the particle-mixed ink 80 remaining on the surface of the dyed layer 3 is removed with the blade 65 pressed to the surface of the dyed layer 3, and the surface is wiped further by a felt roller 10. The removal of ink by the blade 65 becomes easy because the ink wetted to the heat-resistant particles 81 is removed, when compared with an ink not including heat-resistant particles.

The pressure P is set so as to form an ink layer of a thickness almost equal to the particle size of heat-resistant particles 81 on the surface of the dyed layer 3.

The particle-mixed ink 80 is prepared by mixing heat-resistant particles 81 with the above-mentioned ink. Further, the size of the heat-resistant particles 81 are set at an appropriate value so as to transmit the heat due to the heating elements 8 of the thermal head 7 sufficiently to the surface of the dyed layer 3 and to secure spaces to supply dye between the thermal head 7 and the dyed layer 3.

A recording medium 1 has a dyed layer 3 applied to the surface of a substrate 2, as shown in FIG. 17(A).

As shown in the procedure of FIGS. 17(B)–(E), an ink fluid layer 6 of a nearly uniform thickness is formed first with the wire bar 5 on the surface of the dyed layer 3 of a recording medium 1 (FIG. 17(B)). When the thermal head 7 presses the dyed layer 3 via the ink layer 6, the heat-resistant particles play a role of spacers and an ink of a thickness according to the particle size of the heat-resistant particles 81 between the thermal head 7 and the dyed layer 3 (FIG. 17(C)). At the same time, the particle-mixed ink 80 is heated selectively according to image signals by supplying power to the heating elements 8 of the thermal head 7, and the diffusion F of dye occurs from the ink 80 into the dyed layer 3. After this heating, the particle-mixed ink 80 remaining on the surface of the dyed layer 3 is removed by the blade 65 (FIG. 17(D)). Thus, a recording image 82 can be obtained due to diffusion (FIG. 17(F)).

As explained above, when the particle-mixed ink 80 is heated, spaces according to the particle size of heat-resistant particles 81 exist between the thermal head 7 and the dyed layer 3, and a constant amount of ink is held in the spaces. Therefore, the ink supplied on heating becomes uniform, and the image quality of the obtained recording image 82 is better than those obtained in Examples 1 and 2.

Further, special thermal heads such as used in the first, second and third embodiments are not needed, and a prior art thermal head can be used. Thus, the cost of the apparatus can be lowered.

The amount of supplied ink becomes unstable if the materials composing the particles 81 melt, soften or dissolve to deform shapes when the particle-mixed ink 80 is heated. Therefore, it is necessary for particles to have heat-resistance at temperatures attained on heating. The shape of the particles 81 is preferably spherical in order to smooth the flow of ink. However, various kinds of shapes such as bar, cube, polygon, conical porous body or hollow shape can also be used.

The heat-resistant particles 81 are made for example from glass powders, powders of inorganic material such as aluminum oxide, titanium oxide, silicon oxide, tin oxide, aluminum sulfate, quartz powder talc or calcium carbonate, powders of a thermal-setting resin such as epoxy resin, benzoguanamine resin, melamine resin or silicone resin, powders of thermoplastic resin such as polyamide, polycarbonate or methacrylic resin, or a mixture thereof.

The heat-resistant particles 81 may have a color. For example, inorganic pigments such as graphite, carbon black or red iron oxide, or organic pigments such as disazo yellow 10 G may also be used.

The median size of the heat resistant particles 81 is preferably set to be 50 μm or less. If the median size exceeds 50 μm, the amount of ink supplied between the thermal head 7 and the dyed layer 3 is so large that it becomes difficult to heat the particle-mixed ink 80 in contact with the dyed layer 3 resulting in a decrease in the recording sensitivity and resolution largely due to heating in directions parallel to the surface of the dyed layer 3.

Even if the median size is less than 50 μm, when the particle distribution is wide, there are many particles having sizes larger than 50 μm. Then, the amount of ink held between the thermal head 7 and the dyed layer 3 becomes large and unstable when such large particles are contained. Therefore, it is preferable that the largest particle size also does not exceed 50 μm. Especially, it is preferable that the median size is 20 μm or less and that the largest particle size is 50 μm or less, because under these conditions the recording sensitivity is high and the image quality is good.

The volume occupied by the heat-resistant particles 81 in the particle-mixed ink 80 against the total volume of the ink is preferably 50 vol % or less. If the heat-resistant particles 81 are mixed over 50 vol %, the recording sensitivity becomes lower and the fluidity becomes worse because heat is absorbed by the heat-resistant particles 81 more than the dye included in the particle-mixed ink 80.

The hardness of the heat-resistant particles 81 is preferably lower than that of the surface protection layer of the thermal head 7. If the hardness is higher, the surface protection layer is damaged as recording is repeated, and the life of the thermal head becomes shorter. Particles of the above-mentioned thermosetting resin or thermoplastic resin may also be used as such heat-resistant particles 81.

Figure 18:
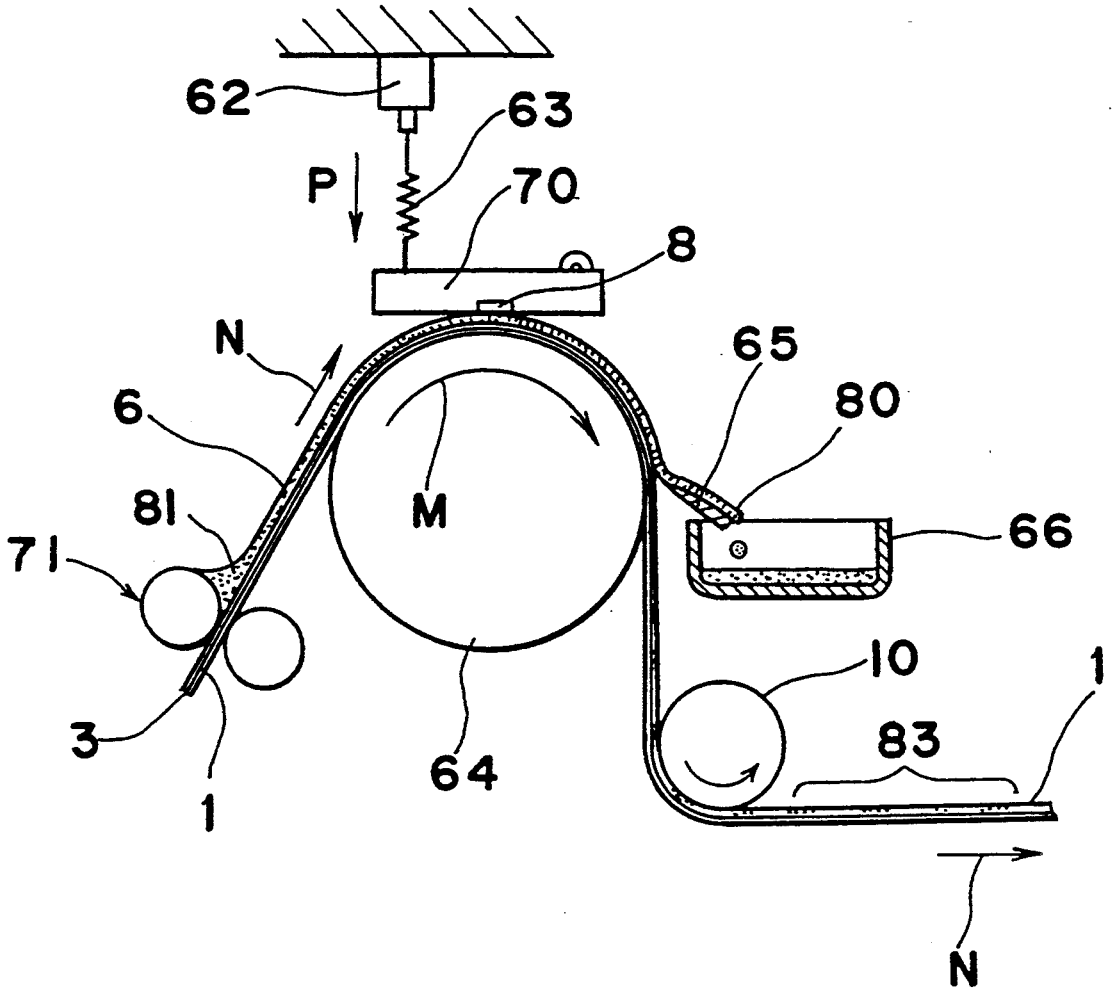
FIG. 18 is a schematic sectional view of a dye recording apparatus of a seventh embodiment.

FIG. 18 shows schematically a dye recording apparatus of a seventh embodiment. The dye recording apparatus is the same as that shown in FIG. 12. A prior art thermal head 70 of plane type having a surface with insubstantial unevenness is used.

In the thermal head 70 used in this embodiment, many heating elements 8 are arranged in the central area of a heat-resistant substrate at a predetermined pitch in a direction perpendicular to the plane of FIG. 18. This thermal head 70 has a broader contact area than the thermal head 7 having heating elements 8 at the top portion as shown in FIG. 2. It is hard to control the pressure and the spaces between the dyed layer 3 and the thermal head in this embodiment, and this makes it difficult to supply the ink to the heating portions appropriately. However, in this embodiment, the heat-resistant particles play a role as spacers, so that the ink can be supplied even if the contact area is broad, and a recording image 83 of a half-tone image can be obtained stably.

Such a plane-type thermal head 70 has been widely used for heat-transfer printers and facsimile apparatuses for heat-transfer papers. Therefore, it has an advantage that the manufacturing cost is low compared with thermal heads having heating elements at end portions such as shown in FIGS. 2(A) and (B).

In the above-mentioned sixth and seventh embodiments, the thermal head 7, 70 is pressed after a uniform ink fluid layer 6 is formed on the surface of the dyed layer 3 with a wire bar 5 or with the ink supplier 71. However, it is not necessary in this embodiment to form a uniform fluid ink layer because the ink becomes uniform due to the heat-resistant particles 81. For example, the ink may simply be dropped on the surface of the dyed layer 3 before the pressing of the thermal head 7, 70.

Further, the particle-mixed ink 80 collected in the ink collection container 66 may be recycled. At this time, it may be judged to recycle or not by using a sensor such as a transmission type photosensor for detecting the density of the ink.

EXAMPLE 9

As to the dye recording apparatus of the seventh embodiment shown in FIG. 18, four kinds of particle-mixed ink 80 compiled in Table 2 and a pure ink not mixed with particles are used for recording. Then, the results summarized in Table 3 are obtained. The ink is prepared by mixing with a ball mill. The thermal head 70 has heating elements 8 each having a resistance of 800Ω, and they are arranged with 6 elements/mm of the arrangement density or pitch. The pressure P of the thermal head 70 is 1 kg/line. The recording signal to the heating elements 8 is modulated as to pulse width, and the maximum pulse width applied to the heating elements 8 is 4 ms and the applied voltage is 15 V. A recording medium 1 used has a substrate 2 of white PET film (trade name: white PET-U6, Teijin Ltd.) of 80 μm thickness of polyethylene terephthalate, while a butyral resin (trade name: BMS, Sekisui Chemical Co., Ltd.) dyed layer 3 of 10 μm thickness is formed on the white substrate.

TABLE 2

| | solvent: propylene glycol | cyan dye: indoaniline[a] | heat-resistant particles |
|---|---|---|---|
| ink (1) | 80 parts | 20 parts | benzoguanamine resin particles: 20 parts (median size: 3.0 μm)[b] |
| ink (2) | 80 parts | 20 parts | calcium bicarbonate: 20 parts (median size: 4.5 μm)[c] |
| ink (3) | 80 parts | 20 parts | silicone resin particles: 20 parts (median size: 5 μm)[d] |
| ink (4) | 80 parts | 20 parts | alumina particles: |

TABLE 2-continued

| | solvent: propylene glycol | cyan dye: indoaniline[a] | heat-resistant particles |
|---|---|---|---|
| | | | 20 parts (median size: 5.5 μm)[e] |
| pure ink | 80 parts | 20 parts | no |

[a]Mitsubishi Kasei Corp.
[b]Nippon Shokubai Kagaku Kogyo Co., Ltd.
[c]Maruo Calcium Co., Ltd.
[d]Toshiba Silicone Co., Ltd.
[e]Fujimi Kenmazai Kogyo Co., Ltd.

TABLE 3

| | scattering of recording density for a recording pulse width | | |
|---|---|---|---|
| | 1 ms | 2 ms | 4 ms |
| ink (1) | 0.41~0.43 | 1.28~1.30 | 1.71~1.72 |
| ink (2) | 0.39~0.42 | 1.25~1.28 | 1.69~1.70 |
| ink (3) | 0.35~0.37 | 1.18~1.19 | 1.65~1.67 |
| ink (4) | 0.29~0.32 | 1.05~1.10 | 1.53~1.58 |
| pure ink | 0.10~0.15 | 0.23~0.31 | 0.57~0.70 |

It is clear that the inks (1)–(4), listed in Table 3, mixed with heat-resistant particles 81 have smaller scattering of recording density and have better image quality when compared with the ink not mixed with particles. It is to be noted that the ink not mixed with particles 81 has a lower recording density for each pulse width. This is ascribable to insufficient supply of ink due to a smaller gap between the thermal head 70 and the dyed layer 3 because the thermal head 70 presses the ink at the pressure P.

The ink (4) including alumina as heat-resistant particles 81 has a recording density somewhat lower than the inks (1) to (3) and a larger scattering of density. This may be ascribable to the alumina as a result of its hardness becomes pushed into the dyed layer 3 and shaves it. Thus, the recording image 83 (referring to FIG. 18) may become uneven lowering the reflection density. Further, when alumina is used, the surface of the protection layer of the thermal head 70 is also damaged. Therefore, the life of the thermal head 70 may be shortened. It, it is preferable to use the above-mentioned resin particles which are not likely to damage the dyed layer 3.

Figure 19:
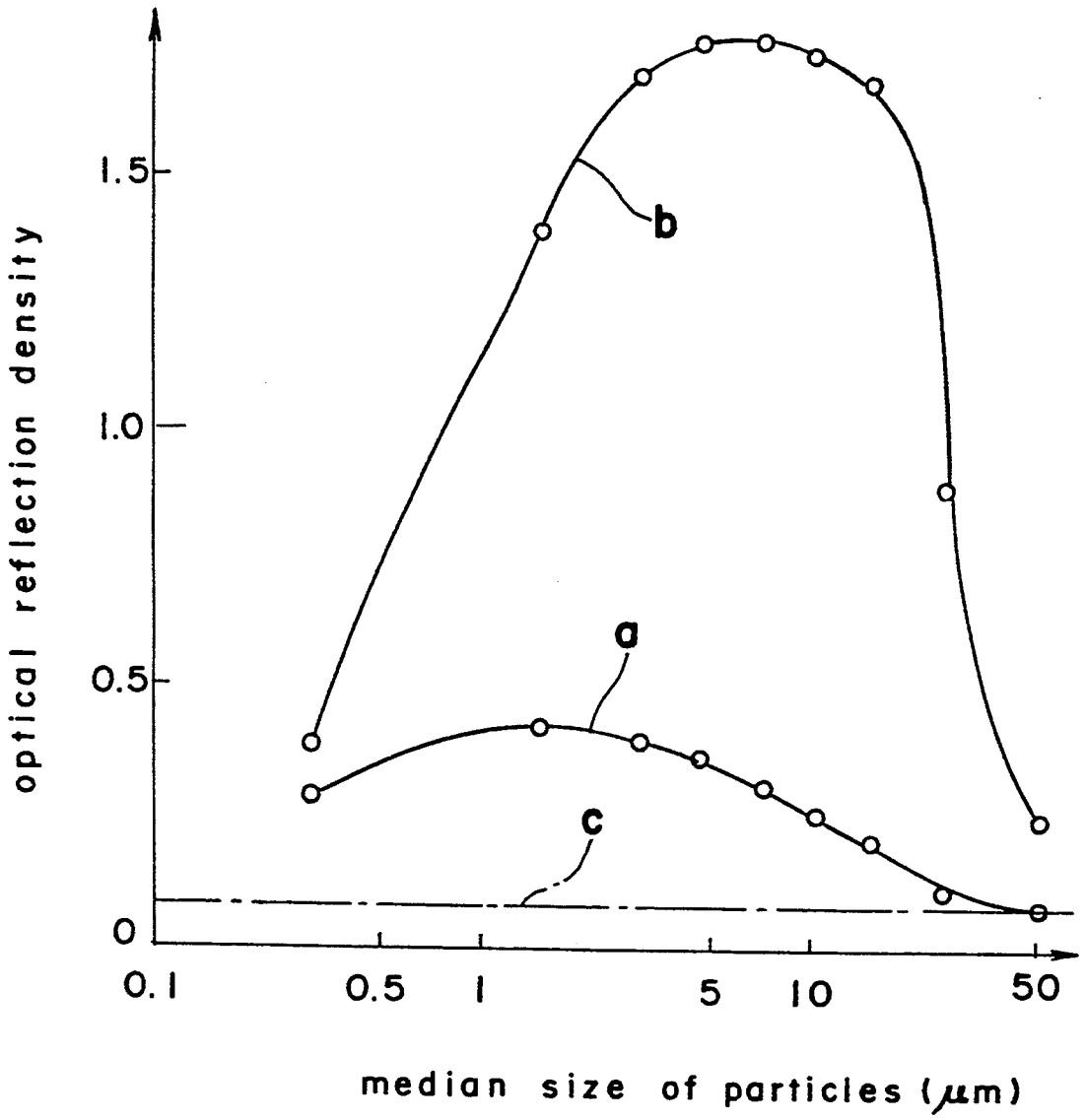
FIG. 19 is a graph of recording characteristics of Example 9 with use of the dye recording apparatus of the seventh embodiment.

FIG. 19 shows a recording characteristic when the median size of the heat-resistant particles mixed in the ink (1) is changed, wherein the abscissa designates the median size of the heat-resistant particles while the ordinate designates optical reflection density of a recording image. Solid lines "a" and "b" show density characteristics when the pulse width for heating elements is 1 ms and 4 ms, respectively; the density of paper sheet (the surface of recording medium itself) is shown as a line "c".

It is found that if the median size of the heat-resistant particles exceeds 50 μm, the recording density becomes very low. It is preferable that the median size is between 1.5 and 20 μm because the density is high and gradation is expressed well.

Table 4 shows the recording results when the pressure P of the thermal head is changed while the ink (2) listed in Table 2 is used and the pulse width applied to heating elements is kept at 4 ms.

TABLE 4

| pressure P | scattering of recording density |
|---|---|
| 0.2 kg | 1.71~1.94 |
| 1.0 kg | 1.71~1.72 |
| 1.5 kg | 0.5 or less |

When 0.2 kg of pressure P is applied, the scattering of the recording density becomes somewhat larger than that when 1.0 kg of pressure P is applied, because the amplitude of the spaces between the thermal head 70 and the dyed layer becomes unstable a little. Further, when 1.5 kg of pressure P is applied, the recording density becomes very low. This is ascribable to the fact that the spaces between the thermal head 70 and the dyed layer become very small so that the ink supply becomes insufficient when compared to the case where of 1.0 kg of pressure p is applied.

EXAMPLE 10

The dye recording apparatus shown in FIG. 18 is used. Table 5 shows the composition of various kinds of inks including silicone oil. A ball mill is used for mixing with the oils. Further, a heat-transfer sheet used for a prior art heat-transfer recording apparatus shown in Table 6 is prepared. The mixing rate of the dye is increased in accordance to the specifications of heat-transfer sheets used in this embodiment.

TABLE 5

| | solvent: silicone oil[f] | cyan dye: indoaniline[a] | heat-resistant particles |
|---|---|---|---|
| ink (5) | KF 96(20cp): 80 parts | 20 parts | no |
| ink (6) | KF 96(20cp): 80 parts | 20 parts | calcium bicarbonate: 20 parts (median size: 4.5 μm)[2] |

[a]Mitsubishi Kasei Corp.
[c]Maruo Calcium Co., Ltd.
[f]Shin-Etsu Chemical Co., Ltd.

TABLE 6

| | sheet-like substrate | ink layer |
|---|---|---|
| thickness | 6 μm | 5 μm |
| material | polyester[g] | butyral resin[h]: 60 wt %<br>dye[a]: 40 wt % |

[a]Mitsubishi Kasei Corp.
[g]Toray Industries, Inc.
[h]Sekisui Chemical Co., Ltd.

Figure 20:
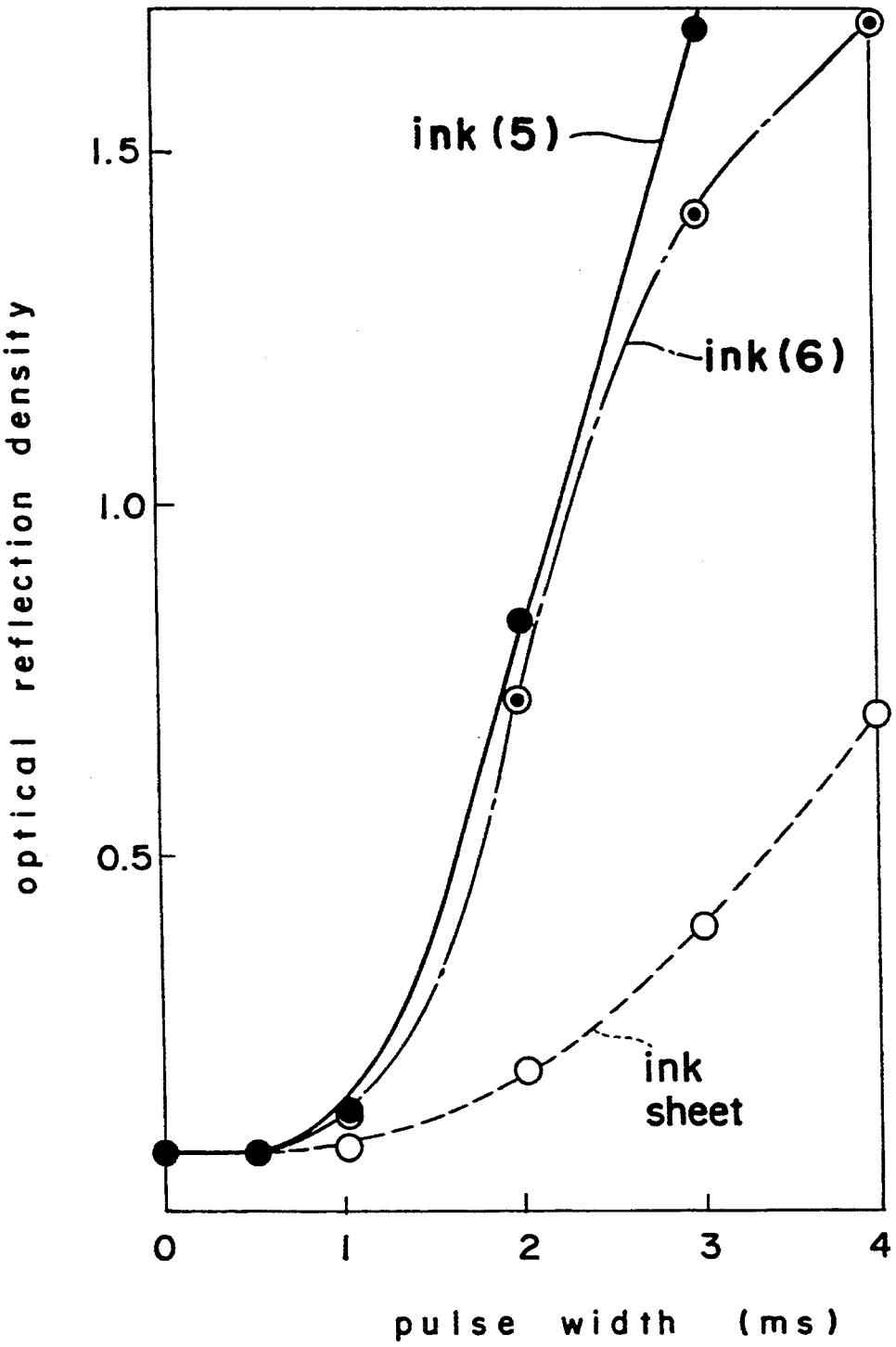
FIG. 20 is a graph of recording characteristics of Example 10 with use of the dye recording apparatus of the seventh embodiment.

FIG. 20 shows the recording data when the inks shown in Tables 5 and 6 are used. The thermal head has heating elements each having a resistance of 800Ω, and they are arranged with a density of 6 elements/mm. The pressure P of the thermal head to the platen roller is 0.5 kg/line. The recording signal applied to the heating elements is modulated as to pulse width, and the maximum pulse width applied to the heating elements is 4 ms and the applied voltage is 18 V. A recording medium used has a substrate of white PET film (trade name: white PET-U6, Teijin Ltd.) of 80 μm thickness of polyethylene terephthalate, while a butyral resin (trade name: BMS, Sekisui Chemical Co., Ltd.) dyed layer of 10 μm thickness is formed on the white substrate.

The recording data with use of the dye recording apparatus of Table 6, shown in FIG. 18, is obtained by using an ink sheet attached temporarily to a recording medium 1 and detached after the recording on heating with the thermal head 70, similarly to a prior art heat-transfer recording apparatus of sublimation type. It is found that the ink (5) listed in Table 5 makes the recording sensitivity higher. Further, it is found that the ink (6) mixed with heat-resistant particles gives a recording image 83 of good image quality, though the recording density becomes low somewhat.

Further, when the entire dyed layer 3 is heated further by subjecting the recording medium 1 to a heat roller, resulting in a portion previously having 1.7 of maximum density in the recording image 83 obtained with the ink (6) has 2.5 of maximum density. This phenomenon is investigated with use of a microscope, and it is observed that the adhesion of dye particles to the surface of the dyed layer 3 increases with increasing density. It is considered that the resin material included in the dyed layer 3 softens on heating and allows the adhesion of dye particles without coloring. Therefore, it is guessed that the dye particles during re-heating and increase the density. Thus, a recording image 83 of high density can be obtained by heating again the entire surface of the dyed layer 3.

Figure 21:
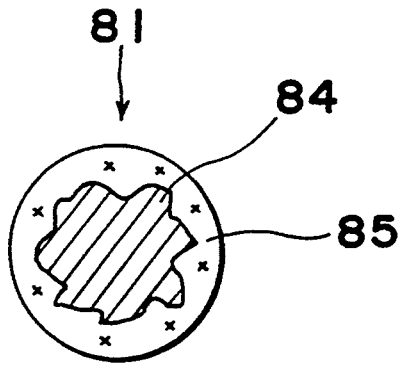
FIG. 21 is a schematic sectional view of a heat-resistant particle mixed in an example of ink for dye recording according to the present invention.

Further, as displayed in FIG. 21, heat resistant particles or resin particles may consist of particles 84 of good thermal conductance and resin layers 85 coating the surface of the particles 84 to smooth the surface. Such resin particles may also be used as the heat-resistant particles 81. These resin particles have better thermal conductance than the particles consisting only of resin due to the presence of particles 84 as core material. Therefore, the interface between the dyed layer 3 and the particle-mixed ink 80 can be heated efficiently due to the heat conduction via the heat-conduction particles 84.

A similar effect can also be realized by mixing heat-conducting particles 84 in the ink. However, the heat-resistant particle 81 shown in FIG. 21 is covered with a resin layer 85 so that the hardness on the surface of the particles is similar to resin particles. Using these particles, there is less damage to the dyed layer 3 (referring to FIG. 18), and on the protection layer at the surface of the thermal head 70 becomes smaller, and degradation of image quality during use over a long period of time can be prevented. Thus, recording can be performed with a lower energy and the recording sensitivity improved when compared with recording using heat-resistant particles consisting only of resin particles.

The thermal conducting particles 84 may be made from a metal such as copper, stainless steel or iron, or an inorganic material such as alumina, graphite or glass may be used.

A heat-resistant material such as polycarbonate, benzoguanamine resin, melamine resin or polyimide which does not melt or soften against the heating due to the thermal head is selected as the resin included in the resin layer 85.

The heat-resistant particles 81 may be manufactured by dispersing heat-resistant particles 84 in a solution of resin composing the resin layer 85 and by atomizing the dispersion solution with a spray and then vaporizing the solvent. By using this technique, spherical particles having smooth surfaces can be prepared irrespective of the shape of the thermal-conducting particles 84.

Further, the heat-resistant particles 81 used in the above-mentioned Examples may be particles having uneven but smooth surfaces.

In Examples 6 and 7, the ink need not include heat-resistant particles 81. However, in this case, the pressure by the thermal head has to be set at an appropriate value so that an ink layer of a predetermined thickness is always formed on the surface of the dyed layer 3.

Figure 22:
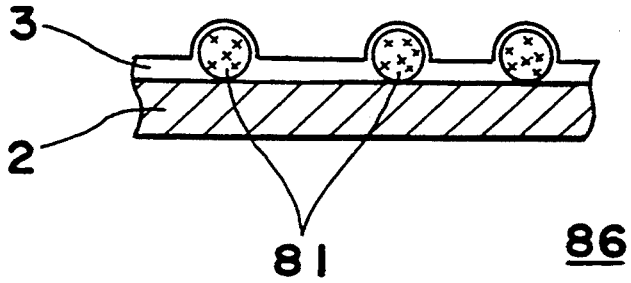
FIG. 22 is a schematic sectional view of a recording medium used for a dye recording apparatus of an eighth embodiment.

Next, a dye recording method and a dye recording apparatus which can obtain a half-tone image of good image quality are explained by using a prior art thermal head, an ink used in Examples 1 to 3, and a recording medium having an uneven surface. FIG. 22 shows schematically a sectional view of a recording medium 86 used for a dye recording apparatus of an eighth embodiment, wherein the uneven recording medium 86 is made from the materials explained above. That is, a dyed layer 3 including heat-resistant particles 81 is formed on a sheet-like substrate 2, and the surface of the dyed layer 3 becomes uneven due to existence of the heat-resistant particles 81. Recording is performed with heating by carrying this recording medium 86 to the dye recording apparatus shown in FIG. 18 and by supplying an ink not mixed with heat-resistant particles. In this case, heaps of the dyed layer 3 play a role as spacers, to supply a constant amount of ink and to obtain a recording image of good image quality.

However, the removal of ink is insufficient in this embodiment when a blade is used. Therefore, air blowing, cleaning with another solvent or the like is necessary in addition to a felt roller. Further, though heat-resistant particles 81 are used to make the dyed layer 3 uneven, the dyed layer 3 may also be manufactured to have an uneven surface with use of a prior art printing technique.

Figure 23:
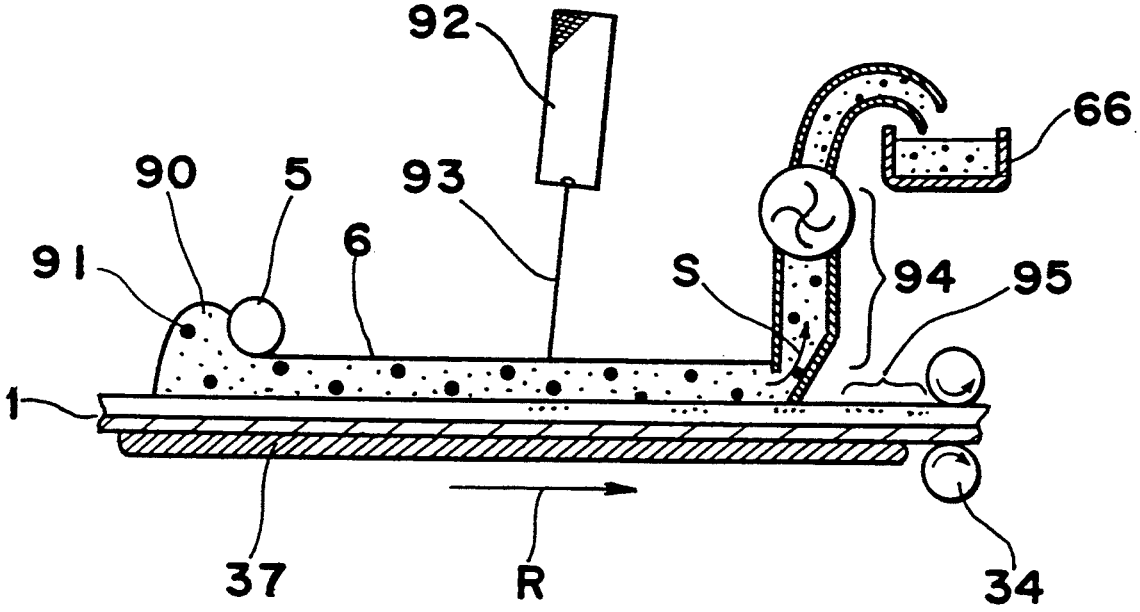
FIG. 23 is a schematic sectional view of a dye recording apparatus of a ninth embodiment.

FIG. 23 shows schematically a section of a dye recording apparatus of a ninth embodiment. Numeral 90 designates a light-absorbing ink which is a fluid ink for dye recording, including dye and light-absorbing particles 91. Numeral 92 designates a laser oscillator for oscillating a laser beam 93 according to a signal source (not shown). Numeral 94 designates an ink absorber for absorbing the light-absorbing ink 90 on the surface of the recording medium 1 to remove the ink 90 and for carrying it to the ink collection container (not shown).

The procedure of recording is as follows: First, a recording medium 1 is carried on a plate 37 with a platen 34 in a direction R, while the light absorbing ink 90 is applied to the surface with a wire bar 5 for forming an ink fluid layer 6. The laser beam 93 is emitted to the ink fluid layer 6 according to signals from the signal source. Then, light-absorbing particles 91 absorb laser light to transform light into heat in order to heat the light-absorbing ink 90. At this time, the laser beam 93 scans the whole sheet surface for recording in a direction perpendicular to the sheet. Next, the ink 90 is absorbed for removal from the surface of the recording medium 1 with the ink absorber 94 in a direction of an arrow S to collect the ink in the ink collection container 66, and a final recording image 95 can be obtained.

In this embodiment, the laser beam can be focused with a lens. Therefore, a recording finer than that with use of the above-mentioned thermal head can be realized. Further, heating is carried out without making contact with the ink 90, so that the laser head need not be cleaned. For a multi-color recording, only a plurality of ink suppliers are needed, and the apparatus can be simplified.

The light-absorbing ink 90 may be prepared by mixing any of the above-mentioned inks with light-absorbing particles 91. The light-absorbing particles 91 may be made from a material such as carbon which has a low transmittance at the oscillation frequency of the laser light 93.

As the laser oscillator 92, various kinds of laser oscillators such as a gas laser, a semiconductor laser or a solid state laser may be used. Then, the solvent included in the ink 90 and the light-absorbing particles 81 are selected so as to absorb the light of the oscillation frequency.

For the scanning of laser light 93, for example a polygon mirror such as those electronic photographic copying machines may be used.

If the absorption frequency of the solvent included in the ink agrees with the wavelength of the laser light 93, it is not needed to mix light-absorbing particles 91. Further, a recording medium may be heated from the side of the plate 37 in order to get heat more from the laser light 93.

EXAMPLE 11

The composition of the light-absorbing ink 90 is 80 weight parts of dimethyl silicone oil (trade name: KF9 of Shin-Etsu Chemical Co., Ltd.) and 20 weight parts of indoaniline cyan dye (Mitsubishi Kasei Corp.), and 20 weight of carbon black (trade name: RAVEN 1255 of Columbia Carbon Nippon Co., Ltd.) as particle-absorbing particles 91. The ink is prepared as follows: First, carbon is mixed with silicone oil and is crushed sufficiently. Next, dye is mixed with silicone oil and is crushed sufficiently with a ball mill. Finally, the two mixtures are mixed together. The thickness of the ink fluid layer 6 on the surface of the dyed layer 3 is about 5 μm.

A semiconductor laser (trade name: LN 9740, Matsushita Electric Industrial Co., Ltd.) is used for the laser oscillator, and its optical output is 40 mW and the oscillation frequency is 800 nm. The pulse width is controlled according to image signals. The feed speed of the recording medium 1 is 10 mm/s. The laser light 93 is focused with a lens system, and a recording image 95 of fine gradation of 1 dot of the order of 10 μm can be obtained.

Further, recording is performed for comparison by supplying a light-absorbing ink without carbon under the same recording conditions. A recording image of fine gradation can be obtained similarly though the density becomes lower somewhat. It is considered that silicone oil itself has a property to absorb 800 nm of light. That is, the light absorption property of a solvent against the laser light 93 may also be used.

Further, in the above-mentioned Examples, the recording medium is displayed as a continuous sheet. However, if the recording medium is a sheet, recording can be performed similarly by adding a means such as an adhesive tape for fixing the recording medium.

In the embodiments, the protection layer of the thermal head is made of a layer. However, it may be composed of two or more layers consisting of for example a heat-resistant protection layer.

In the embodiments, the dyed layer has no color. However, a dyed layer to be used may have been dyed with a color material, or an image may have been printed with use of a prior art printing technique.

Further, in order to control ink viscosity on supplying ink, the ink may be heated just before the supply.

In the embodiments, a recording image obtained with dye recording is used as a final image. However, after a dye recording image is formed in the dyed layer of the sheet-like recording medium, the dyed layer may be transferred to another substrate to form a final image.

The recording speed may be improved by heating the recording medium by means in addition to the heater in the thermal head so as not to be dyed only due to the contact of ink. Then, the heat amount is lowered by the heater to enhance the recording speed.

As to recycling of the ink, not only dye, but also the ink or a concentrated liquid including a solvent may be added.

A dye recording apparatus may also be constructed by combining various components. For example, in the apparatus shown in FIG. 16, the ink absorbing machine 94 shown in FIG. 23 may be used instead of the blade 65.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dye recording method, comprising the steps of:
providing a printing medium having a dyed layer suitable for receiving a dye;
supplying a fluid ink including said dye on a surface of said dyed layer of said printing medium;
heating said fluid ink; and
removing said fluid ink from said surface of said dyed layer.

2. The dye recording method according to claim 1, wherein said fluid ink includes a solvent having low solubility into said dyed layer.

3. The dye recording method according to claim 2, wherein said solvent has a boiling point higher than a melting point, a boiling point or a sublimation point of said dye.

4. The dye recording method according to claim 1, wherein said fluid ink supplied in said supplying step comprises a constant thickness.

5. The dye recording method according to claim 1, wherein said step of supplying a fluid ink comprises the steps of: providing at least one heating element in contact with said fluid ink at a contact area on said surface of said dyed layer, said at least one heating element being heated with application of electric power in said step of heating; and, supplying said fluid ink to said contact area; wherein said fluid ink is heated by said at least one heating element in said step of heating.

6. The dye recording method according to claim 1, wherein said supplying step comprises the steps of: providing at least one heating element near the surface of said dyed layer, said at least one heating element being treated with application of electric power in said step of heating; and supplying said fluid ink between said at least one heating element and the surface of said dyed layer; wherein said fluid ink around the surface of said dyed layer is heated by said at least one heating element in said step of heating.

7. The dye recording method according to claim 1, wherein said heating step comprises heating said fluid ink with a laser beam emitted from a laser oscillator.

8. The dye recording method according to claim 1, wherein said fluid ink is heated at selected positions of said dyed layer of said printing medium according to signals which represent positions of an image in said heating step.

9. The dye recording method according to claim 1, wherein said fluid ink is heated during said heating step with a heat amount which is varied at a plurality of levels according to signals representing dye density of an image to be recorded.

10. The dye recording method according to claim 1, wherein said fluid ink includes dye particles of a median size of 50 μm or less.

11. The dye recording method according to claim 1, wherein said printing medium is moved in a predetermined feeding direction during said supplying step relative to said at least one heating element.

12. The dye recording method according to claim 1, further comprising the step of heating said dyed layer after said fluid ink is removed from said surface in said removing step.

13. The dye recording method according to claim 1, further comprising the step of collecting said fluid ink removed in said removing step.

14. The dye recording method according to claim 13, further comprising the step of adding said fluid ink collected during said collecting step to said fluid ink for use in said supplying step.

15. The dye recording method according to claim 14, wherein dye is added to said collected fluid ink in said adding step so as to keep dye density constant.

16. The dye recording method according to claim 1, wherein said dye included in said fluid ink can diffuse into said dyed layer when heated resulting in the dying of said dyed layer, and said fluid ink further comprises a solvent with low solubility into said dyed layer of said printing medium.

17. The dye recording apparatus according to claim 16, wherein said dye included in said fluid ink can diffuse into said dyed layer when heated resulting in the dying of said dyed layer, and said fluid ink further comprises a solvent with low solubility into said dyed layer of said printing medium.

18. The dye recording method according to claim 1, wherein said heating step is carried out with use of a thermal head comprising:

a plurality of heating elements formed on a substrate; and a protection layer formed on said plurality of heating elements, which layer comprises an uneven surface in a direction crossing said plurality of heating elements so as to form liquid passages for said fluid ink.

19. A dye recording apparatus, comprising:

a printing medium having a dyed layer suitable for receiving a dye;

a fluid ink including said dye;

an ink supplier for supplying said fluid ink on a surface of said dyed layer of said printing medium;

a heater for heating said fluid ink selectively; and a removing device for removing said fluid ink from said surface of said printing medium;

whereby said fluid ink supplied by said ink supplier is heated with said heater and said fluid ink is removed after heating from said dyed layer with said removing device to obtain a dye printing image on said printing medium.

20. The dye recording apparatus according to claim 19, wherein said fluid ink includes a solvent having a low solubility into said dyed layer.

21. The dye recording apparatus according to claim 20, wherein said solvent has a boiling point higher than a melting point, a boiling point or a sublimation point of said dye.

22. The dye recording apparatus according to claim 20, wherein said solvent includes water.

23. The dye recording apparatus according to claim 20, wherein said solvent includes alcohol.

24. The dye recording apparatus according to claim 20, wherein said alcohol includes polyhydric alcohol.

25. The dye recording apparatus according to claim 20, wherein said solvent includes silicone oil.

26. The dye recording apparatus according to claim 19, wherein said fluid ink includes dye particles of a median size of 50 μm or less.

27. The dye recording apparatus according to claim 19, wherein said heater includes a laser oscillator for emitting a laser beam, whereby said fluid ink is heated by said laser beam without said oscillator making contact with said fluid ink.

28. The dye recording apparatus according to claim 29, wherein said fluid ink comprises light-absorbing particles dispersed in said fluid ink which absorb said laser beam emitted from said laser oscillator.

29. The dye recording apparatus according to claim 19, wherein said heater comprises heating elements which are heated with application of electric power, whereby the heating elements make contact with said dyed layer by way of said fluid ink.

30. The dye recording apparatus according to claim 19, further comprising feeding means for feeding said printing medium in a predetermined feeding direction relative to and making contact with said heater.

31. The dye recording apparatus according to claim 30, further comprising pressing means for pressing said heater to said dyed layer by way of said fluid ink at a pressure so that an ink layer of a prescribed thickness can be formed according to relative movement of said heater against said printing medium, wherein said heater is positioned at a predetermined distance from said dyed layer, said heater selectively heating said ink layer.

32. The dye recording apparatus according to claim 30, further comprising pressing means for pressing said heater to said dyed layer by way of said fluid ink at a pressure so that an ink layer of a prescribed thickness can be formed according to relative movement of said heater against said printing medium, said ink further including heat-resistant particles, wherein said heater is positioned at a predetermined distance from said dyed layer, said heater selectively heating said ink layer.

33. The dye recording apparatus according to claim 32, wherein said heat-resistant particles have a median size of 50 μm or less.

34. The dye recording apparatus according to claim 32, wherein said heat-resistant particles are made of resin material.

35. The dye recording apparatus according to claim 32, wherein said heat-resistant particles comprise a thermally conductive substance and surfaces of said heat-resistant particles are coated with resin material.

36. The dye recording apparatus according to claim 30, further comprising a pressing means for pressing said heater to said dyed layer by way of said fluid ink at a pressure sufficient to ensure that liquid passages formed on a surface of said heater at a contact area of said heater and said fluid ink are filled with said fluid ink due to movement of said printing medium relative to said heater, said heater positioned in a manner proximate to said dyed layer, wherein said heater is heated through application of electric power so as to reflect an image signal resulting in heating said dye in said fluid ink so that said dye diffuses at selected positions of said printing medium.

37. The dye recording apparatus according to claim 36, wherein said heater includes a plurality of heating elements and of said plurality of heating elements on a surface of said heater, said at least one heap positioned between adjacent heating elements.

38. The dye recording apparatus according to claim 37, wherein said at least one heap has a height above a surface of said liquid passages of said heater of between 1 and 50 μm.

39. The dye recording apparatus according to claim 36, wherein flow direction of said fluid ink in said liquid passages is consistent with said predetermined feeding direction of said printing medium.

40. The dye recording apparatus according to claim 36, wherein said ink supplier supplies said fluid ink only to said liquid passages so as for said fluid ink not to make contact with said dyed layer except for at a pressing area where said pressing means presses said heater to said dyed layer.

41. The dye recording apparatus according to claim 19, wherein said fluid ink supplier comprises a porous body which can be impregnated with said fluid ink and make contact with said dyed layer to supply said ink to said dyed layer.

42. The dye recording apparatus according to claim 19, comprising a plurality of fluid inks each comprising different dyes, and a plurality of said ink suppliers corresponding to each of said fluid inks, wherein said printing medium can be dyed with said dyes and said ink suppliers are arranged along a predetermined feeding direction of said printing medium.

43. The dye recording apparatus according to claim 19, wherein said ink supplier applies said fluid ink to said surface of said dyed layer before said heater makes contact with said surface.

44. The dye recording apparatus according to claim 19, wherein said ink supplier includes a stirrer for stirring said fluid ink.

45. The dye recording apparatus according to claim 19, wherein said dyed layer of said printing medium has an uneven surface.

46. The dye recording apparatus according to claim 19, further comprising an ink collector, said ink collector collecting said fluid ink removed by said removing device and resupplying said collected fluid ink to said ink supplier.

47. The dye recording apparatus according to claim 19, further comprising a second heater for heating said dyed layer after said ink is removed by said removing device.

48. The dye recording apparatus according to claim 19, wherein said heater comprises:

a plurality of heating elements formed on a substrate; and a protection layer formed on said plurality of heating elements, which layer comprises an uneven surface in a direction crossing said plurality of heating elements so as to form liquid passages for fluid ink.

* * * * *